US010921739B2

(12) United States Patent
Fujiwara

(10) Patent No.: US 10,921,739 B2
(45) Date of Patent: Feb. 16, 2021

(54) NIP FORMER, FIXING DEVICE, AND IMAGE FORMING APPARATUS

(71) Applicant: Hitoshi Fujiwara, Kanagawa (JP)

(72) Inventor: Hitoshi Fujiwara, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/750,066

(22) Filed: Jan. 23, 2020

(65) Prior Publication Data

US 2020/0285178 A1 Sep. 10, 2020

(30) Foreign Application Priority Data

Mar. 7, 2019 (JP) ..... JP2019-041222
Nov. 11, 2019 (JP) ..... JP2019-204023

(51) Int. Cl.
*G03G 15/20* (2006.01)

(52) U.S. Cl.
CPC ..... *G03G 15/2053* (2013.01)

(58) Field of Classification Search
CPC ..... G03G 15/2017; G03G 15/2039; G03G 15/2053; G03G 2215/20; G03G 2215/2003
See application file for complete search history.

(56) References Cited

U.S. PATENT DOCUMENTS

2012/0008971 A1* 1/2012 Lee ..... G03G 15/2064 399/69
2013/0064586 A1 3/2013 Adachi et al.
2014/0056625 A1 2/2014 Naitoh et al.
2014/0072354 A1 3/2014 Toyoda et al.
2014/0093288 A1 4/2014 Naitoh et al.
2014/0099146 A1 4/2014 Fujii et al.
2014/0112691 A1 4/2014 Nanno et al.
2014/0153982 A1 6/2014 Adachi et al.
2014/0153983 A1 6/2014 Fujii et al.
2015/0248091 A1 9/2015 Nanno et al.
2015/0293481 A1* 10/2015 Takahashi ..... G03G 15/2053 399/329
2015/0346662 A1 12/2015 Kawarasaki et al.
2016/0378028 A1 12/2016 Fujiwara et al.
(Continued)

FOREIGN PATENT DOCUMENTS

JP 2017-116922 6/2017
JP 2017-161880 9/2017

*Primary Examiner* — Thomas S Giampaolo, II
(74) *Attorney, Agent, or Firm* — Oblon, McClelland, Maier & Neustadt, L.L.P.

(57) ABSTRACT

A nip former includes a base, an enhanced thermal conductor including an insertion hole, and a securing member including an inserting portion to be inserted into the insertion hole to attach the securing member to the enhanced thermal conductor such that the enhanced thermal conductor and the securing member sandwich the base. The inserting portion has a width that is smaller than a width of the insertion hole in a pressurization direction of an opposed rotator that presses against the nip former via a belt. The inserting portion does not contact an upstream wall and a downstream wall of the insertion hole in the pressurization direction of the opposed rotator and a direction opposite the pressurization direction of the opposed rotator in a state in which the securing member is secured to the base and the opposed rotator presses against the enhanced thermal conductor via the belt.

19 Claims, 13 Drawing Sheets

(56) References Cited

U.S. PATENT DOCUMENTS

| | | | | |
|---|---|---|---|---|
| 2017/0176906 | A1 | 6/2017 | Sawada et al. | |
| 2017/0255149 | A1 | 9/2017 | Takagi et al. | |
| 2018/0364625 | A1* | 12/2018 | Yagi ..... | G03G 15/2053 |
| 2020/0285182 | A1* | 9/2020 | Takahashi ..... | G03G 15/2053 |

* cited by examiner

NIP FORMER, FIXING DEVICE, AND IMAGE FORMING APPARATUS

CROSS-REFERENCE TO RELATED APPLICATIONS

This patent application is based on and claims priority pursuant to 35 U.S.C. § 119(a) to Japanese Patent Application Nos. 2019-041222, filed on Mar. 7, 2019, and 2019-204023, filed on Nov. 11, 2019, in the Japan Patent Office, the entire disclosure of each of which is hereby incorporated by reference herein.

BACKGROUND

Technical Field

Exemplary aspects of the present disclosure relate to a nip former, a fixing device, and an image forming apparatus, and more specifically, to a nip former, a fixing device incorporating the nip former, and an image forming apparatus incorporating the nip former.

Discussion of the Background Art

Related-art image forming apparatuses, such as copiers, facsimile machines, printers, and multifunction peripherals (MFP) having two or more of copying, printing, scanning, facsimile, plotter, and other functions, typically form an image on a recording medium according to image data by electrophotography.

Such image forming apparatuses include a fixing device including a fixing rotator such as a fixing belt and an opposed rotator such as a pressure roller. A nip former contacts an inner circumferential surface of the fixing belt and presses against the pressure roller via the fixing belt to form a fixing nip between the fixing belt and the pressure roller.

The nip former includes an enhanced thermal conductor having an increased thermal conductivity, that is disposed opposite the fixing belt. The enhanced thermal conductor evens the temperature of the fixing belt in a longitudinal direction thereof.

SUMMARY

This specification describes below an improved nip former configured to be pressed by an opposed rotator in a pressurization direction via a belt rotatable in a rotation direction to form a nip between the belt and the opposed rotator. In one embodiment, the nip former includes a base and an enhanced thermal conductor including at least one insertion hole having a first width in the pressurization direction of the opposed rotator. The at least one insertion hole includes an upstream wall and a downstream wall disposed downstream from the upstream wall in the pressurization direction of the opposed rotator. A securing member is separately provided from the base and the enhanced thermal conductor. The securing member includes at least one inserting portion to be inserted into the at least one insertion hole in a direction perpendicular to the pressurization direction of the opposed rotator to attach the securing member to the enhanced thermal conductor such that the enhanced thermal conductor and the securing member sandwich the base. The at least one inserting portion has a second width in the pressurization direction of the opposed rotator. The second width is smaller than the first width of the at least one insertion hole. The at least one inserting portion does not contact the upstream wall and the downstream wall of the at least one insertion hole in the pressurization direction of the opposed rotator and a direction opposite the pressurization direction of the opposed rotator in a state in which the securing member is secured to the base and the opposed rotator presses against the enhanced thermal conductor via the belt.

This specification further describes an improved fixing device. In one embodiment, the fixing device includes a belt that rotates in a rotation direction and an opposed rotator disposed opposite the belt. A heater heats the belt. A nip former is pressed by the opposed rotator in a pressurization direction via the belt to form a fixing nip between the belt and the opposed rotator. The nip former includes the base, the enhanced thermal conductor, and the securing member described above.

This specification further describes an improved image forming apparatus. In one embodiment, the image forming apparatus includes an image forming device that forms an image and a fixing device that fixes the image on a recording medium. The fixing device includes the belt, the opposed rotator, the heater, and the nip former described above.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

Figure 1:
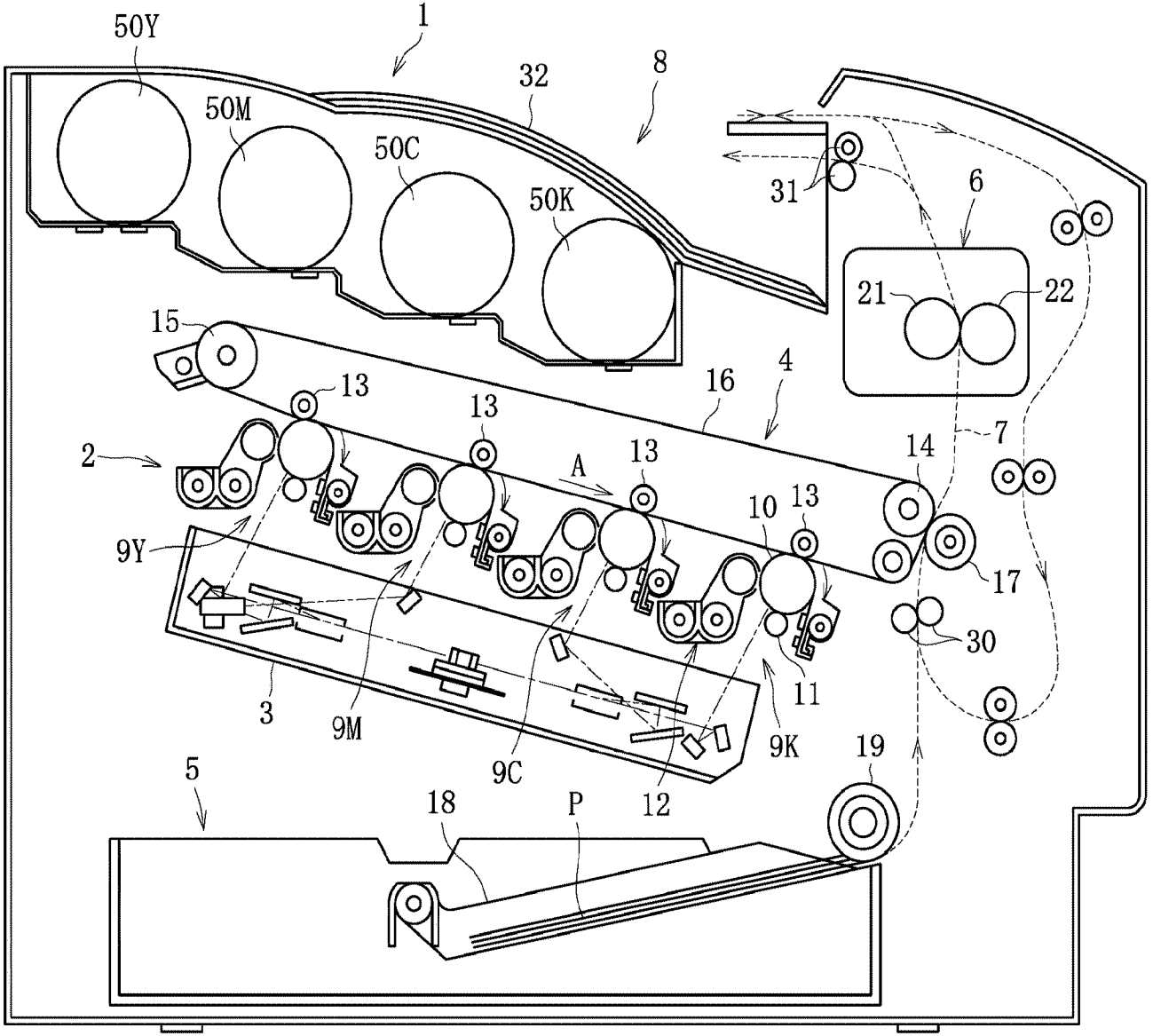
FIG. 1 is a schematic cross-sectional view of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

Referring to drawings, a description is provided of embodiments of the present disclosure.

In the drawings, identical reference numerals are assigned to identical elements and equivalents and redundant descriptions of the identical elements and the equivalents are summarized or omitted properly.

Referring to FIG. 1, a description is provided of a construction of an image forming apparatus 1 that forms a color toner image on a recording medium.

An image forming device 2 is disposed in a center portion of the image forming apparatus 1. The image forming device 2 includes four process units 9Y, 9M, 9C, and 9K that are removably installed in the image forming device 2. The process units 9Y, 9M, 9C, and 9K have a similar construction except that the process units 9Y, 9M, 9C, and 9K contain developers in different colors, that is, yellow (Y), magenta (M), cyan (C), and black (K), respectively, which correspond to color separation components for a color image.

For example, each of the process units 9Y, 9M, 9C, and 9K includes a photoconductive drum 10, a charging roller 11, and a developing device 12. The photoconductive drum 10 is a drum-shaped rotator serving as an image bearer that bears a toner image formed with toner as a developer on a surface thereof. The charging roller 11 uniformly charges the surface of the photoconductive drum 10. The developing device 12 includes a developing roller that supplies toner onto the surface of the photoconductive drum 10, forming a toner image thereon.

An exposure device 3 is disposed below the process units 9Y, 9M, 9C, and 9K. The exposure device 3 emits a laser beam according to image data.

A transfer device 4 is disposed above the image forming device 2. The transfer device 4 includes a driving roller 14, a driven roller 15, an intermediate transfer belt 16, and primary transfer rollers 13. The intermediate transfer belt 16 is an endless belt stretched taut across the driving roller 14 and the driven roller 15 such that the intermediate transfer belt 16 is rotatable in a rotation direction A. The primary transfer rollers 13 are disposed opposite the photoconductive drums 10 of the process units 9Y, 9M, 9C, and 9K, respectively, via the intermediate transfer belt 16. The primary transfer rollers 13 press against an inner circumferential surface of the intermediate transfer belt 16, bringing an outer circumferential surface of the intermediate transfer belt 16 into contact with the photoconductive drums 10 and forming primary transfer nips between the intermediate transfer belt 16 and the photoconductive drums 10, respectively.

A secondary transfer roller 17 is disposed opposite the driving roller 14 via the intermediate transfer belt 16. The secondary transfer roller 17 presses against the outer circumferential surface of the intermediate transfer belt 16. Thus, a secondary transfer nip is formed between the secondary transfer roller 17 and the intermediate transfer belt 16 contacted by the secondary transfer roller 17. The driving roller 14, the intermediate transfer belt 16, and the secondary transfer roller 17 serve as an image transferor that transfers a toner image onto a sheet P.

A sheet feeder 5 is disposed in a lower portion of the image forming apparatus 1. The sheet feeder 5 includes a sheet feeding tray 18 (e.g., a paper tray) and a sheet feeding roller 19. The sheet feeding tray 18 loads a plurality of sheets P serving as recording media. The sheet feeding roller 19 picks up and feeds a sheet P from the sheet feeding tray 18.

A conveyance path 7 conveys the sheet P picked up from the sheet feeder 5. A plurality of conveying roller pairs, in addition to a registration roller pair 30, is disposed properly in the conveyance path 7 that leads to a sheet ejector 8 described below.

A fixing device 6 includes a fixing belt 21 heated by a heater and a pressure roller 22 that presses against the fixing belt 21.

The sheet ejector 8 is disposed downstream from the conveyance path 7 at a most downstream portion of the image forming apparatus 1 in a sheet conveyance direction. The sheet ejector 8 includes a sheet ejection roller pair 31 and a sheet ejection tray 32. The sheet ejection roller pair 31 ejects the sheet P onto an outside of the image forming apparatus 1. The sheet ejection tray 32 stocks the sheet P ejected onto the outside of the image forming apparatus 1.

Toner bottles 50Y, 50M, 50C, and 50K are disposed in an upper portion of the image forming apparatus 1 and replenished with yellow, magenta, cyan, and black toners, respectively. The toner bottles 50Y, 50M, 50C, and 50K are removably installed in the image forming apparatus 1. The toner bottles 50Y, 50M, 50C, and 50K supply fresh yellow, magenta, cyan, and black toners to the developing devices 12 through supplying tubes disposed between the toner bottles 50Y, 50M, 50C, and 50K and the developing devices 12, respectively.

Referring to FIG. 1, a description is provided of a basic image forming operation performed by the image forming apparatus 1 having the construction described above.

As the image forming apparatus 1 starts the image forming operation, an electrostatic latent image is formed on the surface of the photoconductive drum 10 of each of the process units 9Y, 9M, 9C, and 9K. The exposure device 3 exposes the photoconductive drums 10 according to image data. The image data is monochrome image data created by decomposing desired full color image data into yellow, magenta, cyan, and black image data. The drum-shaped developing roller supplies the toner stored in the developing device 12 to the electrostatic latent image formed on the photoconductive drum 10, visualizing the electrostatic latent image as a visible toner image (e.g., an image developed with a developer).

In the transfer device 4, as the driving roller 14 is driven and rotated, the driving roller 14 drives and rotates the intermediate transfer belt 16 in the rotation direction A. Each of the primary transfer rollers 13 is applied with a voltage at a polarity opposite a polarity of charged toner under one of a constant voltage control and a constant current control. Thus, a transfer electric field is created at each of the primary transfer nips. The toner images formed on the photoconductive drums 10, respectively, are transferred onto the intermediate transfer belt 16 successively at the primary transfer nips such that the toner images are superimposed on the intermediate transfer belt 16, thus forming a full color toner image on the intermediate transfer belt 16.

On the other hand, as the image forming operation starts, in the lower portion of the image forming apparatus 1, the sheet feeding roller 19 of the sheet feeder 5 starts being driven and rotated, feeding a sheet P of the plurality of sheets P loaded in the sheet feeding tray 18 to the conveyance path 7. The registration roller pair 30 conveys the sheet P sent to the conveyance path 7 to the secondary transfer nip formed between the secondary transfer roller 17 and the intermediate transfer belt 16 pressed by the driving roller 14 at a time when the full color toner image formed on the intermediate transfer belt 16 reaches the secondary transfer nip. The secondary transfer roller 17 is applied with a transfer voltage having a polarity opposite a polarity of charged toner of the full color toner image formed on the intermediate transfer belt 16, thus creating a transfer electric field at the secondary transfer nip. The transfer electric field formed at the secondary transfer nip transfers the full color toner image formed on the intermediate transfer belt 16 onto the sheet P collectively.

The sheet P transferred with the full color toner image is conveyed to the fixing device 6 where the fixing belt 21 and the pressure roller 22 fix the full color toner image on the sheet P under heat and pressure. The sheet P bearing the fixed toner image is separated from the fixing belt 21. The conveying roller pair conveys the sheet P to the sheet ejector 8 where the sheet ejection roller pair 31 ejects the sheet P onto the sheet ejection tray 32.

The above describes the image forming operation to form the full color toner image on the sheet P. Alternatively, one of the four process units 9Y, 9M, 9C, and 9K may be used to form a monochrome toner image or two or three of the four process units 9Y, 9M, 9C, and 9K may be used to form a bicolor toner image or a tricolor toner image.

Figure 2:
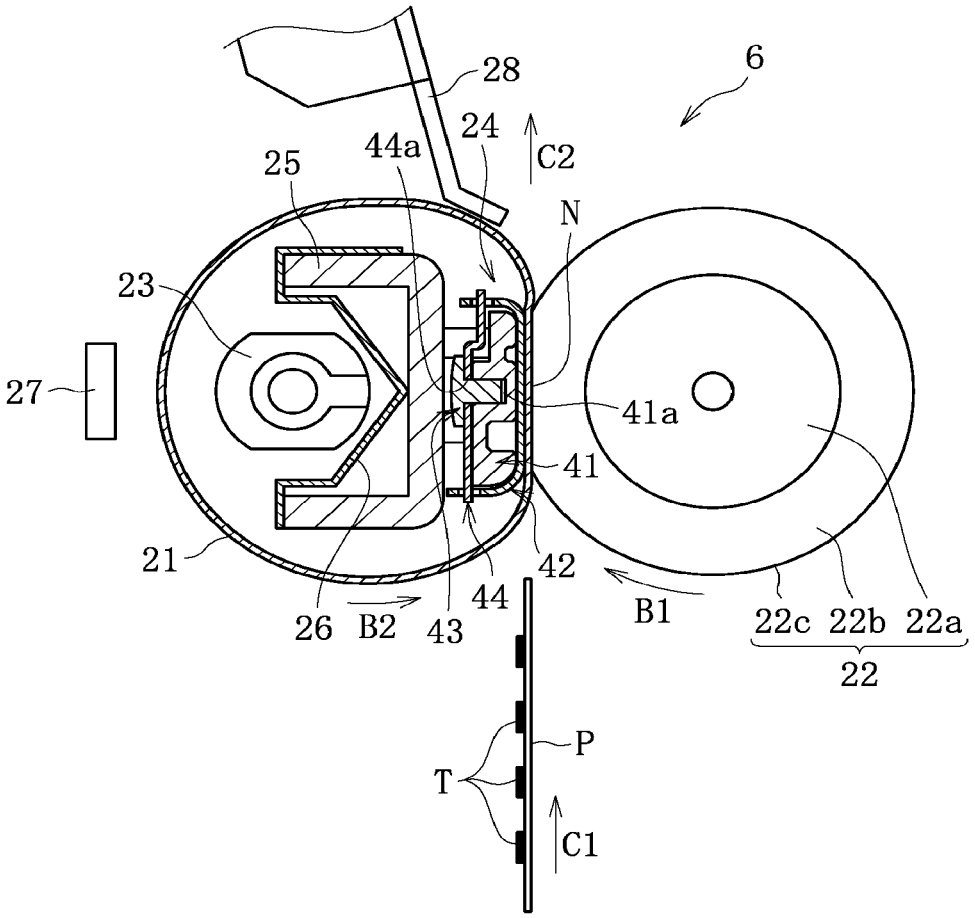
FIG. 2 is a cross-sectional view of a fixing device according to one embodiment of the present disclosure, that is incorporated in the image forming apparatus depicted in FIG. 1.

Referring to FIG. 2, a description is provided of a basic construction of the fixing device 6 incorporated in the image forming apparatus 1 having the construction described above.

As illustrated in FIG. 2, the fixing device 6 includes the fixing belt 21, the pressure roller 22, a halogen heater 23, a nip former 24, a stay 25, a reflector 26, a temperature sensor 27, a separator 28, and a presser. The fixing belt 21 serves as a belt, a fixing rotator, or a fixing member that is rotatable. The pressure roller 22 serves as an opposed rotator or an opposed member that is disposed opposite the fixing belt 21 and rotatable. The halogen heater 23 serves as a heater or a heating member that heats the fixing belt 21. The nip former 24 (e.g., a nip forming pad) is disposed within a loop formed by the fixing belt 21. The stay 25 contacts a back face of the nip former 24, serving as a contact member or an abutment that contacts and supports the nip former 24. The reflector 26 reflects light radiated from the halogen heater 23 to the fixing belt 21. The temperature sensor 27 serves as a temperature detector that detects the temperature of the fixing belt 21. The separator 28 separates the sheet P from the fixing belt 21. The presser presses the pressure roller 22 against the fixing belt 21.

A detailed description is now given of a construction of the fixing belt 21.

The fixing belt 21 is an endless belt or film that is thin and has flexibility. For example, the fixing belt 21 includes a base layer and a release layer. The base layer is an inner circumferential layer made of metal such as nickel and SUS stainless steel or resin such as polyimide (PI). The release layer is an outer circumferential layer made of tetrafluoroethylene-perfluoroalkylvinylether copolymer (PFA), polytetrafluoroethylene (PTFE), or the like. Optionally, an elastic layer made of rubber such as silicone rubber, silicone rubber foam, and fluororubber may be interposed between the base layer and the release layer.

A detailed description is now given of a construction of the pressure roller 22.

The pressure roller 22 includes a cored bar 22*a*, an elastic layer 22*b*, and a release layer 22*c*. The elastic layer 22*b* coats the cored bar 22*a* and is made of silicone rubber foam, silicone rubber, fluororubber, or the like. The release layer 22*c* coats the elastic layer 22*b* and is made of PFA, PTFE, or the like. The presser presses the pressure roller 22 toward the fixing belt 21, pressing the pressure roller 22 against the nip former 24 via the fixing belt 21. At a position where the pressure roller 22 is pressed against the fixing belt 21, the elastic layer 22*b* of the pressure roller 22 is pressed and deformed to form a fixing nip N having a predetermined length in a sheet conveyance direction C1. A driver such as a motor disposed in a body of the image forming apparatus 1 drives and rotates the pressure roller 22. As the driver drives and rotates the pressure roller 22, a driving force is transmitted from the pressure roller 22 to the fixing belt 21 at the fixing nip N, rotating the fixing belt 21 in accordance with rotation of the pressure roller 22.

According to the embodiments, the pressure roller 22 is a solid roller. Alternatively, the pressure roller 22 may be a hollow roller. In this case, a heater or a heat source such as a halogen heater may be disposed inside the pressure roller 22. If the pressure roller 22 does not incorporate the elastic layer 22*b*, the pressure roller 22 attains a decreased thermal capacity that improves fixing property of being heated quickly. However, when the pressure roller 22 presses and deforms an unfixed toner image T to fix the toner image T on the sheet P, slight surface asperities of the fixing belt 21 may be transferred onto the toner image T, causing a solid part of the toner image T to suffer from variation in gloss. In order to prevent this, the pressure roller 22 preferably incorporates the elastic layer 22*b* having a thickness of 100 micrometers or greater. The elastic layer 22*b* having the thickness of 100 micrometers or greater, as the elastic layer 22*b* elastically deforms, absorbs slight surface asperities, preventing variation in gloss of the toner image T. The elastic layer 22*b* may be made of solid rubber. Alternatively, if no heater is disposed inside the pressure roller 22, the elastic layer 22*b* may be made of sponge rubber. The sponge rubber enhances thermal insulation of the pressure roller 22, preferably causing the pressure roller 22 to draw less heat from the fixing belt 21. Instead of a configuration in which an opposed rotator (e.g., the pressure roller 22) and a fixing rotator (e.g., the fixing belt 21) press against each other, the opposed rotator may merely contact the fixing rotator with no pressure therebetween.

A detailed description is now given of a configuration of the halogen heater 23.

Both lateral ends of the halogen heater 23 in a longitudinal direction thereof are secured to side plates of the fixing device 6, respectively. A power supply disposed in the body of the image forming apparatus 1 controls output to the halogen heater 23 to generate heat. The output to the halogen heater 23 is controlled based on a temperature of a surface of the fixing belt 21, which is detected by the temperature sensor 27. Such control of the output to the halogen heater 23 adjusts the temperature, that is, a fixing temperature, of the fixing belt 21 to a desired temperature. Alternatively, as a heater that heats the fixing belt 21, an induction heater (IH), a resistive heat generator, a carbon heater, or the like may be employed instead of a halogen heater.

A detailed description is now given of a construction of the nip former 24.

The nip former 24 extends in a longitudinal direction thereof parallel to a longitudinal direction or an axial direction of the fixing belt 21 or the pressure roller 22 throughout an entire length of each of the fixing belt 21 and the pressure roller 22. The longitudinal direction or the axial direction of the fixing belt 21 and the pressure roller 22 is perpendicular to a plane of paper illustrating FIG. 2. The nip former 24 is secured to and supported by the stay 25. Hence, the nip former 24 is not bent by pressure from the pressure roller 22, attaining a uniform nip length of the fixing nip N in the sheet conveyance direction C1 throughout the entire length of the pressure roller 22 in the axial direction thereof. The construction of the nip former 24 is described below in more detail.

A detailed description is now given of a configuration of the stay 25.

The stay 25 extends in a longitudinal direction thereof throughout an entire length of the nip former 24 in the longitudinal direction thereof. The stay 25 contacts the back face of the nip former 24 throughout the entire length of the nip former 24 in the longitudinal direction thereof, supporting the nip former 24 against pressure from the pressure roller 22. In order to prevent the nip former 24 from being bent, the stay 25 is preferably made of metal having an enhanced mechanical strength such as stainless steel and iron. Alternatively, the stay 25 may be made of resin.

A detailed description is now given of a configuration of the reflector 26.

The reflector 26 is interposed between the stay 25 and the halogen heater 23. According to this embodiment, the reflector 26 is secured to the stay 25. The reflector 26 is made of aluminum, stainless steel, or the like. The reflector 26 disposed as described above reflects light radiated from the halogen heater 23 toward the stay 25 to the fixing belt 21. Accordingly, the reflector 26 increases an amount of light that irradiates the fixing belt 21, heating the fixing belt 21 effectively. Additionally, the reflector 26 suppresses conduction of radiant heat from the halogen heater 23 to the stay 25 and the like, saving energy.

Alternatively, instead of the reflector 26 according to this embodiment, a heater side face of the stay 25, that is disposed opposite the halogen heater 23, may be treated with mirror finish by polishing, coating, or the like to produce a reflection face. The reflector 26 or the refection face of the stay 25 preferably has a reflectance of 90 percent or more.

In order to ensure the strength of the stay 25, the shape and the material of the stay 25 are restricted. Hence, the reflector 26 according to this embodiment that is separated from the stay 25 improves flexibility in selecting the shape and the material of the stay 25, specializing the reflector 26 and the stay 25 functionally. Since the reflector 26 is interposed between the halogen heater 23 and the stay 25, the reflector 26 is disposed in proximity to the halogen heater 23, heating the fixing belt 21 effectively.

In order to further improve efficiency in heating the fixing belt 21 by reflecting light, the orientation of the reflector 26 or the reflection face of the stay 25 is examined. For example, if the reflector 26 is disposed on a concentric circle with respect to the halogen heater 23 as a center, the reflector 26 may reflect light to the halogen heater 23, degrading heating efficiency. Conversely, if a part or an entirety of the reflector 26 is oriented to reflect light to the fixing belt 21, not to the halogen heater 23, the reflector 26 decreases an amount of light reflected to the halogen heater 23, improving heating efficiency in heating the fixing belt 21 by reflection of light.

A description is provided of various structural advantages of the fixing device 6 according to the embodiments to save energy and improve a first print out time and the like further.

The first print out time is a time taken by the image forming apparatus 1 to print and deliver a first page of a sheet P onto the sheet ejection tray 32 after receiving a print job. For example, the halogen heater 23 heats the fixing belt 21 directly at a position other than the fixing nip N in a direct heating method. According to the embodiments, no element is interposed between the halogen heater 23 and the fixing belt 21 in an opposite region of the fixing belt 21, which is opposite the fixing nip N, that is, a left region of the fixing belt 21 in FIG. 2. The halogen heater 23 heats the opposite region of the fixing belt 21 directly with radiant heat.

The fixing belt 21 is thin and has a decreased diameter to attain a decreased thermal capacity. For example, the base layer, the elastic layer, and the release layer of the fixing belt 21 have thicknesses in ranges of from 20 micrometers to 50 micrometers, from 100 micrometers to 300 micrometers, and from 10 micrometers to 50 micrometers, respectively. The fixing belt 21 has a total thickness of 1 mm or smaller. The fixing belt 21 has a diameter in a range of from 20 mm to 40 mm. In order to decrease the thermal capacity of the fixing belt 21 further, the fixing belt 21 has a total thickness of 0.2 mm or smaller preferably and 0.16 mm or smaller more preferably. The fixing belt 21 preferably has a diameter of 30 mm or smaller.

According to the embodiments, the pressure roller 22 has a diameter in a range of from 20 mm to 40 mm. Thus, the diameter of the fixing belt 21 is equivalent to the diameter of the pressure roller 22. However, the diameter of each of the fixing belt 21 and the pressure roller 22 is not limited to the above. For example, the diameter of the fixing belt 21 may be smaller than the diameter of the pressure roller 22. In this case, a curvature of the fixing belt 21 is greater than a curvature of the pressure roller 22 at the fixing nip N, facilitating separation of the sheet P ejected from the fixing nip N from the fixing belt 21.

Referring to FIG. 2, a description is provided of basic operations of the fixing device 6 according to the embodiments.

When a power switch of the body of the image forming apparatus 1 is turned on, the halogen heater 23 is supplied with power. The driver starts driving and rotating the pressure roller 22 clockwise in FIG. 2 in a rotation direction B1. Accordingly, the pressure roller 22 drives and rotates the fixing belt 21 frictionally counterclockwise in FIG. 2 in a rotation direction B2.

Thereafter, a sheet P bearing an unfixed toner image T formed in the processes for image formation described above is conveyed in the sheet conveyance direction C1 while the sheet P is guided by a guide plate. The sheet P enters the fixing nip N formed between the fixing belt 21 and the pressure roller 22 pressed against the fixing belt 21. The toner image T is fixed on a surface of the sheet P under heat from the fixing belt 21 heated by the halogen heater 23 and pressure exerted between the fixing belt 21 and the pressure roller 22.

The sheet P bearing the fixed toner image T is conveyed from the fixing nip N in a sheet conveyance direction C2 in FIG. 2. As a leading end of the sheet P contacts a tip of the separator 28, the separator 28 separates the sheet P from the fixing belt 21. Thereafter, as described above, the sheet ejection roller pair 31 ejects the sheet P separated from the fixing belt 21 onto the outside of the image forming apparatus 1 so that the sheet P is stocked on the sheet ejection tray 32.

A description is provided of the construction of the nip former 24 in more detail.

Figure 3:
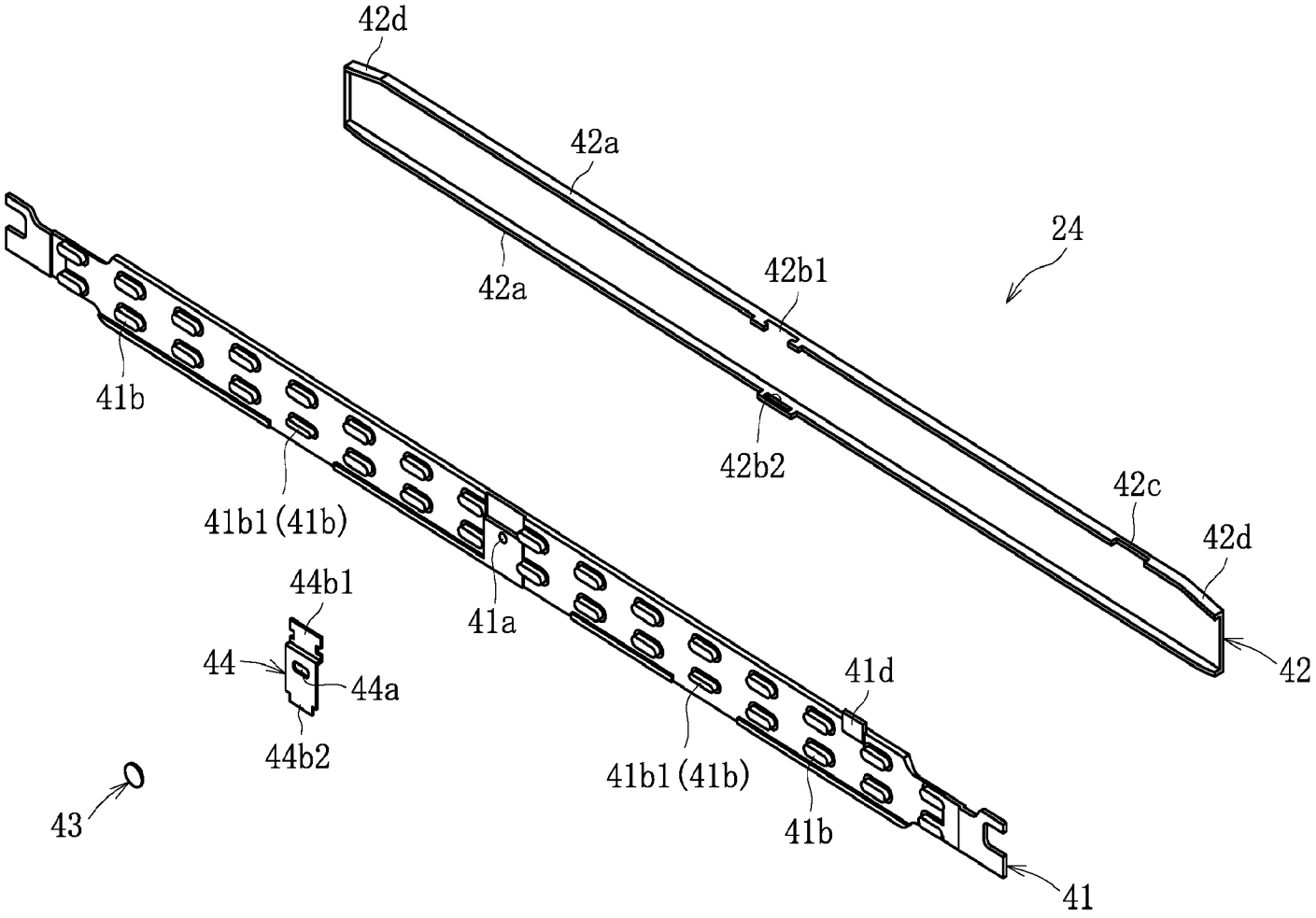
FIG. 3 is an exploded perspective view of a nip former incorporated in the fixing device depicted in FIG. 2.

As illustrated in FIGS. 2 and 3, the nip former 24 includes a base 41, a thermal equalizer 42, a screw 43, and a securing member 44. The thermal equalizer 42 serves as an enhanced thermal conductor. The screw 43 serves as a fastener. The screw 43 fastens and secures the securing member 44 to the base 41. The base 41 and the thermal equalizer 42 extend in the longitudinal direction of the nip former 24.

The base 41 is made of a heat resistant material. For example, the base 41 is made of an inorganic substance such as ceramic, glass, and aluminum, rubber such as silicone rubber and fluororubber, fluororesin such as polytetrafluoroethylene (PTFE), tetrafluoroethylene-perfluoroalkylvinylether copolymer (PFA), ethylene tetrafluoroethylene copolymer (ETFE), fluorinated ethylene propylene (FEP), that is, a copolymer of hexafluoropropylene and tetrafluoroethylene, resin such as polyimide (PI), polyamide imide (PAI), polyphenylene sulfide (PPS), polyether ether ketone (PEEK), liquid crystal plastic, liquid crystal polymer (LCP), phenol resin, nylon, and aramid, and combinations of those.

According to the embodiments, the base 41 is made of LCP having an enhanced heat resistance and an enhanced moldability. For example, the base 41 has a thermal conductivity of 0.54 W/m·K.

The base 41 includes a fastening hole 41*a* with which the securing member 44 is fastened to the base 41. The fastening hole 41*a* is disposed on a center of the base 41 in a longitudinal direction thereof. The fastening hole 41*a* is a hole that does not penetrate through the base 41 and has a bottom disposed in a middle of the base 41 in a thickness direction thereof.

As illustrated in FIG. 3, the base 41 includes a plurality of projections 41*b* that projects toward the stay 25. The plurality of projections 41*b* is arranged in the longitudinal direction of the base 41 in two lines in a short direction of the base 41. The projections 41*b* serve as positioners that contact the stay 25 and position the nip former 24 with respect to the stay 25.

As illustrated in FIG. 2, the thermal equalizer 42 contacts an inner circumferential surface of the fixing belt 21. The thermal equalizer 42 is made of a material having a thermal conductivity greater than a thermal conductivity of the base 41. For example, according to the embodiments, the thermal equalizer 42 is made of SUS stainless steel and has a thermal conductivity in a range of from 16.7 W/m·K to 20.9 W/m·K. Alternatively, for example, the thermal equalizer 42 may be made of a material having an increased thermal conductivity such as a copper based material having a thermal conductivity of 381 W/m·K and an aluminum based material having a thermal conductivity of 236 W/m·K.

The thermal equalizer 42 having an increased thermal conductivity is interposed between the base 41 and the fixing belt 21. The thermal equalizer 42 contacts the fixing belt 21 throughout the entire length of the fixing belt 21 in the longitudinal direction thereof. The thermal equalizer 42 conducts and evens heat in the longitudinal direction of the fixing belt 21, suppressing uneven temperature of the fixing belt 21 in the longitudinal direction thereof.

The thermal equalizer 42 includes bent portions 42*a* disposed on both ends of the thermal equalizer 42 in a short direction thereof, respectively, and extended in a longitudinal direction thereof. As illustrated in FIG. 2, according to the embodiments, the bent portions 42*a* of the thermal equalizer 42 are molded by bending a metal plate in a direction substantially perpendicular to the short direction of the thermal equalizer 42 (e.g., a leftward direction in FIG. 2 that is opposite a direction directed to the fixing nip N) at both ends of the metal plate in a short direction thereof (e.g., an upper end and a lower end of the thermal equalizer 42 depicted in FIG. 2).

As illustrated in FIG. 3, the thermal equalizer 42 includes insertion holes 42*b*1 and 42*b*2 disposed at centers of the bent portions 42*a* in a longitudinal direction thereof and disposed at both ends of the thermal equalizer 42 in the short direction thereof, respectively. The insertion hole 42*b*2 serves as an upstream insertion hole and the insertion hole 42*b*1 serves as a downstream insertion hole disposed downstream from the upstream insertion hole in the rotation direction B2 of the fixing belt 21. Inserting portions of the securing member 44, that are described below, are inserted into the insertion holes 42*b*1 and 42*b*2, respectively. The insertion holes 42*b*1 and 42*b*2 are holes that open in the short direction of the thermal equalizer 42, that is, vertically in FIG. 2, respectively. Sections of the bent portions 42*a* where the insertion holes 42*b*1 and 42*b*2 are situated protrude beyond other sections of the bent portions 42*a* partially in a bent direction of the bent portions 42*a*, respectively. The insertion hole 42*b*1 opens also in a thickness direction of the thermal equalizer 42.

The thermal equalizer 42 includes tapers 42*d* disposed at both lateral ends of the thermal equalizer 42 in the longitudinal direction thereof, respectively. Each of the tapers 42*d* decreases a length of the thermal equalizer 42 in the short direction thereof toward a lateral edge of the thermal equalizer 42 in the longitudinal direction thereof.

The securing member 44 is separately provided from the base 41 and the thermal equalizer 42 and secures the base 41 and the thermal equalizer 42 to the securing member 44. The securing member 44 includes a fastening hole 44*a* disposed at a center of the securing member 44. The screw 43 fastens the securing member 44 to the base 41 through the fastening hole 44*a*. Inserting portions 44*b*1 and 44*b*2 are disposed at both ends of the securing member 44 in the short direction of the base 41, respectively. The inserting portion 44*b*2 serves as an upstream inserting portion and the inserting portion 44*b*1 serves as a downstream inserting portion disposed downstream from the upstream inserting portion in the rotation direction B2 of the fixing belt 21.

Figure 4A:
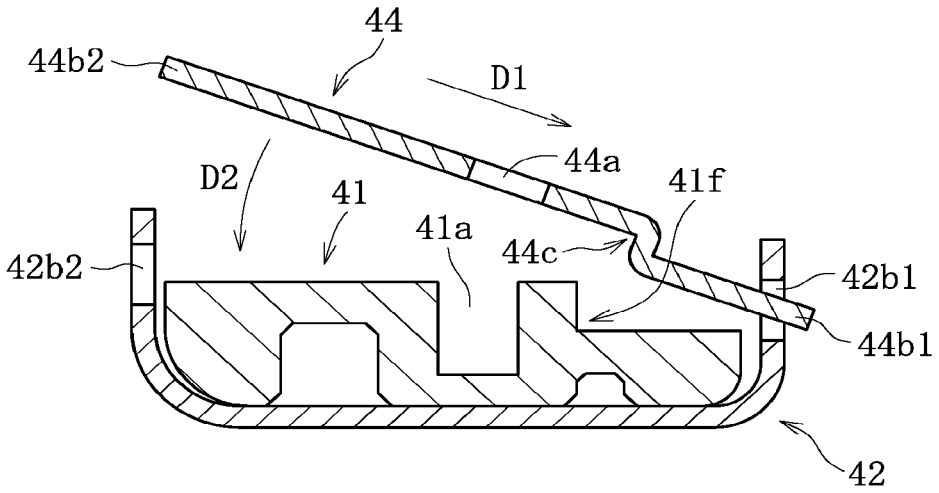
FIG. 4A is a cross-sectional view of a base, a securing member, and a thermal equalizer incorporated in the nip former depicted in FIG. 3, illustrating the securing member being attached to the thermal equalizer.
Figure 4B:
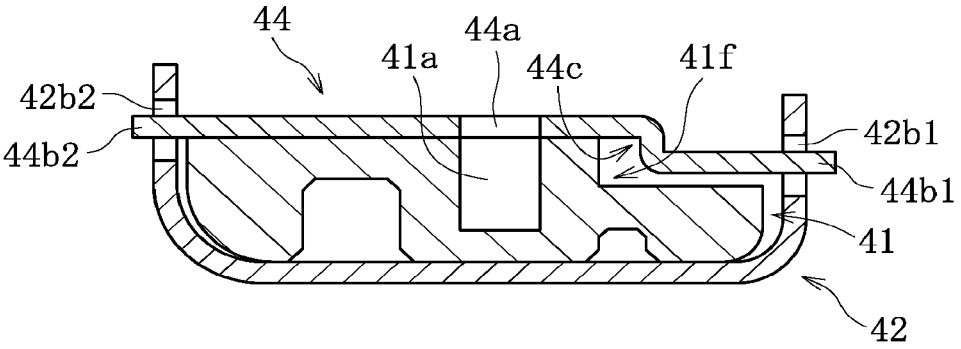
FIG. 4B is a cross-sectional view of the base, the securing member, and the thermal equalizer, illustrating the securing member having been attached to the thermal equalizer.

Referring to FIGS. 4A and 4B, a description is provided of a method for assembling the nip former 24.

The base 41 is fitted into a recess produced between the bent portions 42*a* disposed at both ends of the thermal equalizer 42 in the short direction thereof, respectively. As illustrated in FIG. 4A, the securing member 44 is tilted relative to the thermal equalizer 42. One of the inserting portions 44*b*1 and 44*b*2 of the securing member 44, that is, the inserting portion 44*b*1, is inserted into one of the insertion holes 42*b*1 and 42*b*2 of the thermal equalizer 42, that is, the insertion hole 42*b*1 that corresponds to the inserting portion 44*b*1, in a direction D1. Another one of the inserting portions 44*b*1 and 44*b*2 of the securing member 44, that is, the inserting portion 44*b*2, is pressed down toward the thermal equalizer 42 in a direction D2. The securing member 44 slides slightly leftward in FIG. 4A. Another one of the inserting portions 44*b*1 and 44*b*2 of the securing member 44, that is, the inserting portion 44*b*2, is inserted into another one of the insertion holes 42*b*1 and 42*b*2 of the thermal equalizer 42, that is, the insertion hole 42*b*2. Accordingly, as illustrated in FIG. 4B, the securing member 44 is mounted on the base 41 and attached to the thermal equalizer 42. Alternatively, conversely to the processes described above, the inserting portion 44*b*2 may be inserted into the insertion hole 42*b*2 before the inserting portion 44*b*1 is inserted into the insertion hole 42*b*1. In this state, seen in a cross section at a position in the longitudinal direction of the thermal equalizer 42 where the securing member 44 is disposed, the base 41 is sandwiched between the thermal equalizer 42 and the securing member 44.

Figure 5:
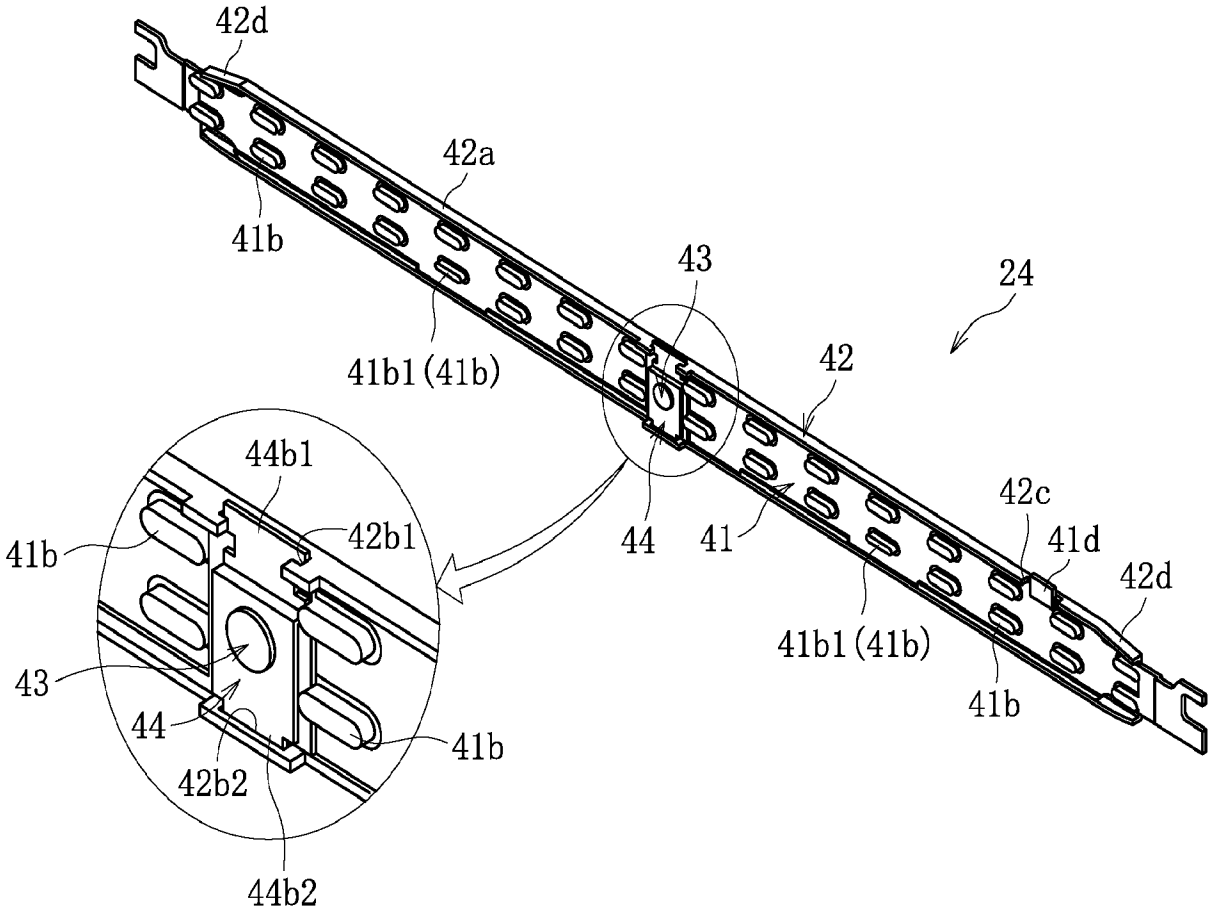
FIG. 5 is a perspective view of the nip former depicted in FIG. 3.

The screw 43 is inserted into the fastening hole 44*a* of the securing member 44 and the fastening hole 41*a* of the base 41 to fasten the securing member 44 to the base 41. Accordingly, as illustrated in FIG. 5, the thermal equalizer 42 and the base 41 are secured to the securing member 44, thus assembling the nip former 24.

As described above, according to the embodiments, in a state in which the securing member 44 is attached to the thermal equalizer 42, the screw 43 fastens the securing member 44 to the base 41, thus securing and positioning the base 41 to the thermal equalizer 42 through the securing member 44. Specifically, the inserting portions 44*b*1 and 44*b*2 of the securing member 44 are inserted into the insertion holes 42*b*1 and 42*b*2 of the thermal equalizer 42, respectively, thus restricting motion of the securing member 44 with respect to the thermal equalizer 42 in the longitudinal direction and the thickness direction of the thermal equalizer 42. For example, the securing member 44 restricts motion of the base 41 fastened to the securing member 44 with respect to the thermal equalizer 42 in the longitudinal direction and the thickness direction of the thermal equalizer 42. The bent portions 42*a* disposed at both ends of the thermal equalizer 42 in the short direction thereof, respectively, restrict motion of the base 41 in the short direction thereof. Thus, the securing member 44 and the thermal equalizer 42 restrict motion of the base 41 with respect to the thermal equalizer 42 in the plurality of directions. In other words, the securing member 44 secures the base 41 to the thermal equalizer 42.

The base 41 and the thermal equalizer 42 are secured through a separate member, that is, the securing member 44. Accordingly, compared to a configuration in which the base 41 is secured and positioned with respect to the thermal equalizer 42 structurally, for example, by engaging the thermal equalizer 42 with the base 41 directly, flexibility in a structure to secure and position the base 41 with respect to the thermal equalizer 42 does not increase. A complex shape to secure the thermal equalizer 42 to the base 41 is not needed. Hence, the securing member 44 positions the base 41 with respect to the thermal equalizer 42 precisely. The base 41 does not shift from the thermal equalizer 42. Accordingly, a separation position at which the sheet P having passed through the fixing nip N separates from the fixing belt 21 does not shift in the longitudinal direction thereof, preventing the sheet P from being creased or jammed and preventing an imaging span disposed at each lateral end of the fixing belt 21 in the longitudinal direction thereof, that is disposed opposite the toner image T on the sheet P, from shifting from the thermal equalizer 42 in the longitudinal direction thereof, for example. Consequently, the thermal equalizer 42 achieves thermal equalization sufficiently in the imaging span on the fixing belt 21, preventing faulty fixing of the toner image T on the sheet P.

The securing member 44 contacts the thermal equalizer 42 partially in the longitudinal direction thereof. Hence, at a position where the securing member 44 contacts the thermal equalizer 42, the base 41 may draw heat from the thermal equalizer 42, causing the thermal equalizer 42 to be subject to temperature decrease and varying the temperature of the fixing belt 21 in the longitudinal direction thereof. For example, according to the embodiments, the securing member 44 is made of metal and therefore draws heat from the thermal equalizer 42 easily.

A description is provided of a construction of a comparative fixing device 6C.

Figure 6:
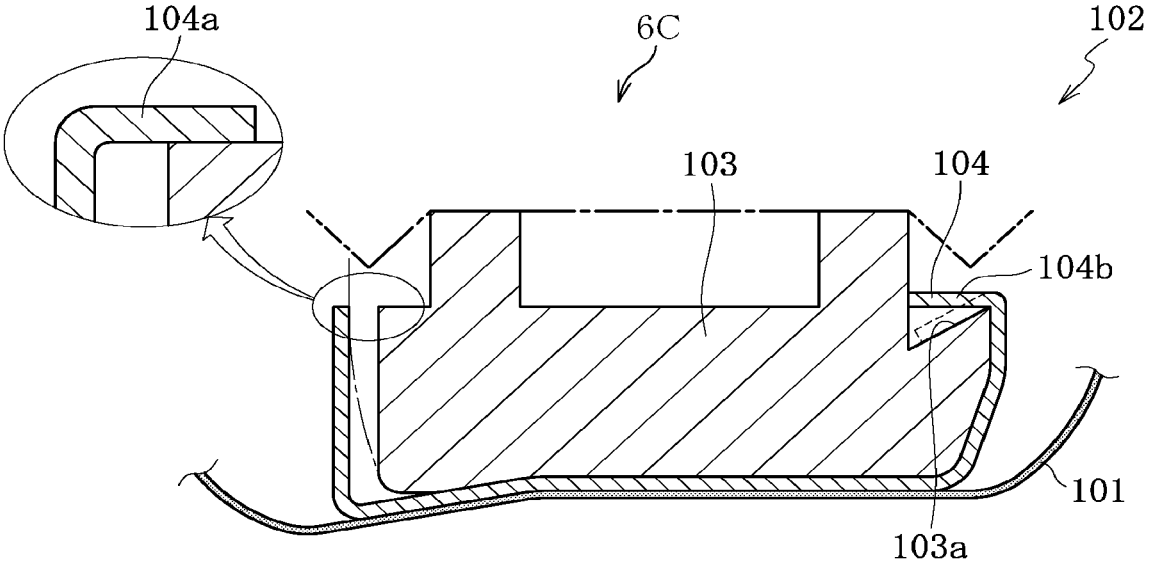
FIG. 6 is a cross-sectional view of a comparative fixing device incorporating a comparative nip former.

As illustrated in FIG. 6, the comparative fixing device 6C includes a comparative nip former 102 that contacts an inner circumferential surface of a fixing belt 101. The comparative nip former 102 includes a base 103 and an enhanced thermal conductor 104 that has a thermal conductivity greater than a thermal conductivity of the base 103. The enhanced thermal conductor 104 includes restrictors 104*a* and 104*b* disposed at both ends of the enhanced thermal conductor 104 in a short direction thereof, respectively. A copper plate is bent for a plurality of times to mold the restrictors 104*a* and 104*b*. The restrictor 104*b* engages a recess 103*a* of the base 103, positioning the enhanced thermal conductor 104 with respect to the base 103.

With a method in which the enhanced thermal conductor 104 engages the base 103 mechanically by using the shape of each of the enhanced thermal conductor 104 and the base 103, attachment error increases as the enhanced thermal conductor 104 is attached to the base 103. To address this circumstance, the enhanced thermal conductor 104 may be secured to the base 103 through a separate securing member. However, the securing member may contact the enhanced thermal conductor 104 partially in a longitudinal direction thereof, varying the temperature of the enhanced thermal conductor 104 in the longitudinal direction thereof.

Figure 7A:
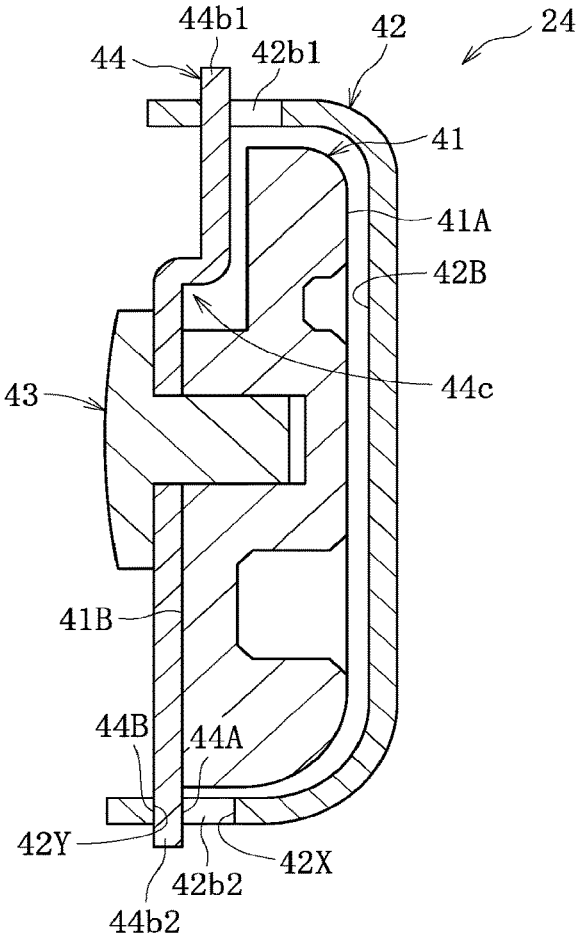
FIG. 7A is a side cross-sectional view of the nip former depicted in FIG. 5, illustrating the thermal equalizer separated from the base.
Figure 7B:
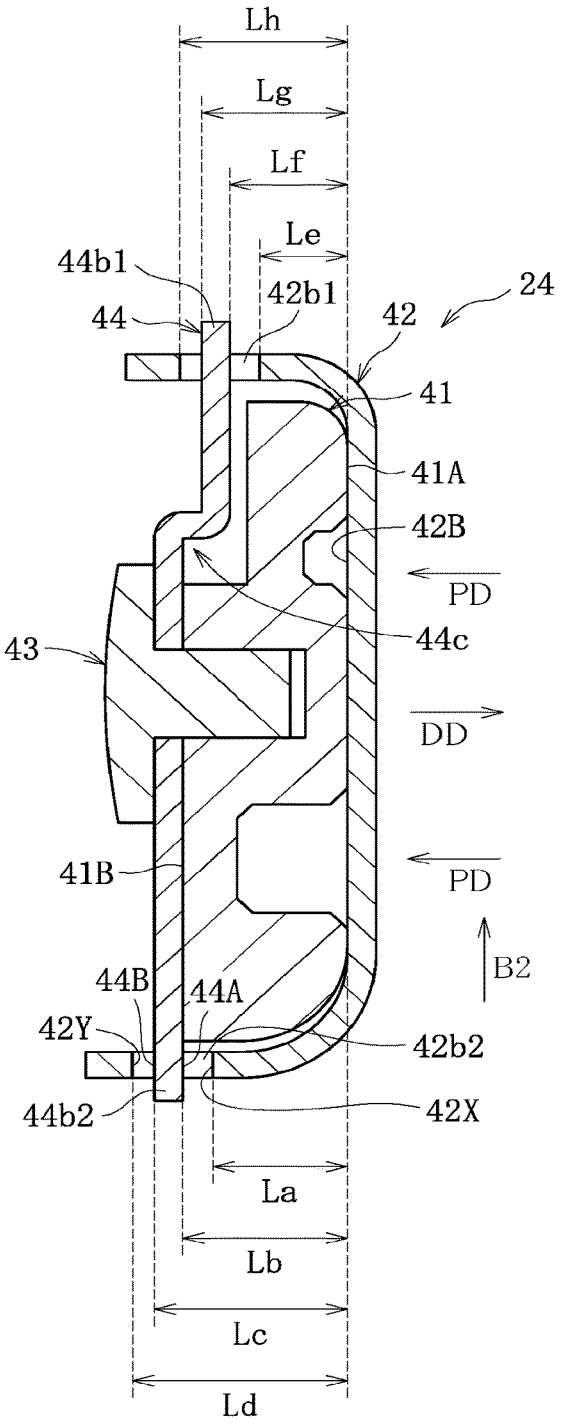
FIG. 7B is a side cross-sectional view of the nip former depicted in FIG. 5, illustrating the thermal equalizer contacting the base.

To address those circumstances, the nip former 24 according to the embodiments of the present disclosure has a construction that decreases the contact area where the securing member 44 contacts the thermal equalizer 42, as described below with reference to FIGS. 7A and 7B. FIG. 7A is a cross-sectional view of the nip former 24 before the nip former 24 receives pressure from the pressure roller 22 as one example. FIG. 7B is a cross-sectional view of the nip former 24 when the nip former 24 receives pressure from the pressure roller 22. FIGS. 7A and 7B illustrate a cross section perpendicular to the fixing nip N.

As illustrated in FIG. 7A, a width of each of the insertion holes 42*b*1 and 42*b*2 of the thermal equalizer 42 in a pressurization direction PD of the pressure roller 22 in which the pressure roller 22 exerts pressure to the nip former 24 (e.g., a horizontal direction in FIGS. 7A and 7B) is greater than a thickness (e.g., a width) of each of the inserting portions 44*b*1 and 44*b*2 of the securing member 44 in the pressurization direction PD of the pressure roller 22. In other words, in a state in which the securing member 44 is attached to the thermal equalizer 42 and fastened to the base 41 with the screw 43, a predetermined backlash is provided between the securing member 44 and the thermal equalizer 42 in the horizontal direction in FIG. 7A. Hence, as illustrated in FIG. 7A, for example, each of the inserting portions 44*b*1 and 44*b*2 contacts a left wall in FIG. 7A of a plurality of walls of each of the insertion holes 42*b*1 and 42*b*2. The left wall is a downstream wall 42Y in the pressurization direction PD of the pressure roller 22. The securing member 44 and the base 41 secured to the securing member 44 are movable rightward in FIG. 7A with respect to the thermal equalizer 42 by the backlash.

As illustrated in FIG. 7B, as the presser presses the pressure roller 22 against the fixing belt 21, the thermal equalizer 42 receives pressure directed leftward in FIG. 7B in the pressurization direction PD. Accordingly, the thermal equalizer 42 moves leftward in FIG. 7B toward the base 41 and the securing member 44. Consequently, a downstream face 42B of the thermal equalizer 42 comes into contact with an upstream face 41A of the base 41 in the pressurization direction PD of the pressure roller 22. The upstream face 41A is a nip side face of the base 41, that faces the fixing nip N via the thermal equalizer 42 and the fixing belt 21. The downstream face 42B is a base side face of the thermal equalizer 42, that faces the base 41 and is opposite a nip side face of the thermal equalizer 42, that faces the fixing nip N via the fixing belt 21. The upstream face 41A faces the fixing nip N via the thermal equalizer 42 and the fixing belt 21. The upstream face 41A and the downstream face 42B that contact each other define a contact position. The inserting portions 44*b*1 and 44*b*2 do not contact the walls (e.g., the downstream wall 42Y and an upstream wall 42X disposed upstream from the downstream wall 42Y in the pressurization direction PD) of the insertion holes 42*b*1 and 42*b*2, respectively, in the pressurization direction PD and a direction DD opposite the pressurization direction PD. The screw 43 fastens the securing member 44 to the base 41 so that a downstream face 41B of the base 41 contacts the securing member 44. The downstream face 41B is a securing member side face of the base 41, that faces the securing member 44. The downstream face 41B is disposed downstream from the upstream face 41A in the pressurization direction PD of the pressure roller 22.

A description is provided of dimensional relations of elements of the nip former 24 with which the inserting portion 44*b*2 does not contact the upstream wall 42X and the downstream wall 42Y of the insertion hole 42*b*2 when the pressure roller 22 presses against the thermal equalizer 42 via the fixing belt 21.

Hereinafter, one side, that is, an upstream side, of the nip former 24 in the pressurization direction PD of the pressure roller 22 defines a right side of the nip former 24 in FIG. 7B. Another side, that is, a downstream side, of the nip former 24 in the pressurization direction PD of the pressure roller 22 defines a left side of the nip former 24 in FIG. 7B.

According to the embodiments, as illustrated in FIG. 7B, a distance Lb is greater than a distance La. Accordingly, an upstream face 44A of the inserting portion 44*b*2 of the securing member 44 does not contact the upstream wall 42X of the insertion hole 42*b*2 of the thermal equalizer 42. The upstream face 44A is a nip side face of the securing member 44, that faces the fixing nip N via the thermal equalizer 42 and the fixing belt 21, and is disposed upstream from a downstream face 44B in the pressurization direction PD of the pressure roller 22. The upstream wall 42X faces the securing member 44. For example, when the thermal equalizer 42 moves leftward from a position depicted in FIG. 7A to a position depicted in FIG. 7B, the downstream face 42B comes into contact with the upstream face 41A before the upstream wall 42X comes into contact with the upstream face 44A.

The distance La defines a distance from the contact position where the base 41 contacts the thermal equalizer 42, that is, the downstream face 42B of the thermal equalizer 42, to the upstream wall 42X in the horizontal direction in FIG. 7B. The upstream wall 42X is an upstream wall of a plurality of walls that defines the insertion hole 42*b*2 in the pressurization direction PD of the pressure roller 22. The distance Lb defines a distance from the downstream face 42B of the thermal equalizer 42 to the upstream face 44A of the securing member 44 in the horizontal direction in FIG. 7B in a state in which the thermal equalizer 42 contacts the base 41. The upstream face 44A is an upstream face of the inserting portion 44*b*2 in the pressurization direction PD of the pressure roller 22. According to the embodiments, the distance Lb equals to a thickness of the base 41. A distance Lf defines a distance from the contact position to the upstream face 44A in the pressurization direction PD of the pressure roller 22. The distance Lf corresponds to the distance Lb. However, the distance Lf defines a width obtained by subtracting a width defined by a bent portion of the securing member 44 from the thickness of the base 41. The securing member 44 is bent rightward in FIG. 7B to produce a step 44*c* that defines the bent portion.

According to the embodiments, a distance Ld is greater than a distance Lc. Accordingly, the downstream face 44B of the inserting portion 44*b*2 of the securing member 44 does not contact the downstream wall 42Y of the insertion hole 42*b*2 of the thermal equalizer 42. The downstream wall 42Y is disposed downstream from the upstream wall 42X in the pressurization direction PD of the pressure roller 22. The distance Lc defines a distance obtained by adding a thickness of the inserting portion 44*b*2 to the distance Lb. In a state in which the thermal equalizer 42 contacts the base 41, the distance Lc defines a distance from the downstream face 42B of the thermal equalizer 42 to the downstream face 44B of the securing member 44. The distance Ld defines a distance obtained by adding a width of the insertion hole 42*b*2 in the horizontal direction in FIG. 7B to the distance La. The distance Ld defines a distance from the downstream face 42B of the thermal equalizer 42 to the downstream wall 42Y of the insertion hole 42*b*2.

With the dimensional relation described above (hereinafter referred to as a first dimensional relation) in which the distance Lb is greater than the distance La and the distance Ld is greater than the distance Lc, in a state in which the pressure roller 22 presses against the thermal equalizer 42 via the fixing belt 21 and the thermal equalizer 42 contacts the base 41 as illustrated in FIG. 7B, a positional relation in which the inserting portion 44*b*2 does not contact the insertion hole 42*b*2 in the horizontal direction in FIG. 7B is obtained. Accordingly, the positional relation decreases the contact area where the thermal equalizer 42 contacts the securing member 44 while the fixing device 6 performs fixing, for example, suppressing conduction of heat from the thermal equalizer 42 to the securing member 44. Hence, the fixing device 6 attains a construction that does not degrade thermal equalization of the thermal equalizer 42 that evens heat in the fixing belt 21 in the longitudinal direction thereof. However, according to the embodiments, the inserting portions 44*b*1 and 44*b*2 contact walls that define the insertion holes 42*b*1 and 42*b*2 in the longitudinal direction of the thermal equalizer 42, respectively, as described below in detail. The inserting portions 44*b*1 and 44*b*2 are not separated from the insertion holes 42*b*1 and 42*b*2, respectively, entirely.

The above describes magnitude relations between the distances La, Lb, Lc, and Ld defined by the insertion hole 42*b*2 and the inserting portion 44*b*2 disposed upstream from the fixing nip N in the sheet conveyance direction C1 or the rotation direction B2 of the fixing belt 21 in a lower part in FIG. 7B. The magnitude relations between the distances La, Lb, Lc, and Ld are also applied to magnitude relations between distances Le, Lf, Lg, and Lh defined by the insertion hole 42*b*1 and the inserting portion 44*b*1 disposed downstream from the fixing nip N in the sheet conveyance direction C1 or the rotation direction B2 of the fixing belt 21. The distances Le, Lf, Lg, and Lh correspond to the distances La, Lb, Lc, and Ld, respectively. For example, a dimensional relation in which the distance Lf is greater than the distance Le and the distance Lh is greater than the distance Lg is attained. The dimensional relation is hereinafter referred to as a second dimensional relation.

The distance Lg defines a distance in the pressurization direction PD of the pressure roller 22, that is obtained by adding a thickness of the inserting portion 44*b*1 to the distance Lf. The distance Lh defines a distance in the pressurization direction PD of the pressure roller 22, that is obtained by adding a width of the insertion hole 42*b*1 to the distance Le. Accordingly, the inserting portion 44*b*1 does not contact the insertion hole 42*b*1. The second dimensional relation decreases the contact area where the thermal equalizer 42 contacts the securing member 44 while the fixing device 6 performs fixing, for example, suppressing conduction of heat from the thermal equalizer 42 to the securing member 44.

The present embodiment satisfies both the first dimensional relation and the second dimensional relation. Alternatively, one of the first dimensional relation and the second dimensional relation may decrease the contact area where the thermal equalizer 42 contacts the securing member 44 advantageously. However, achievement of both the first dimensional relation and the second dimensional relation is preferable.

While the fixing belt 21 rotates, the fixing belt 21 slides over the nip former 24. Hence, the securing member 44 is also exerted with a load caused by sliding of the fixing belt 21 over the nip former 24. To address this circumstance, according to the embodiments, the screw 43 fastens the base 41 through a separate member (e.g., the securing member 44), attaining a mechanical strength advantageously compared to a securing method in which a claw or the like engages structurally.

As illustrated in FIG. 4B, according to the embodiments, the base 41 includes a step 41*f* and the securing member 44 includes the step 44*c*. The step 41*f* is disposed opposite the step 44*c*. The step 41*f* has a shape that corresponds to a shape of the step 44*c*. The steps 41*f* and 44*c* improve attachment of the securing member 44 to the base 41. A shape of a front of the securing member 44 is asymmetrical to a shape of a back of the securing member 44 in a short direction thereof. Thus, the securing member 44 is not installed erroneously upside down and inside out.

Figure 8:
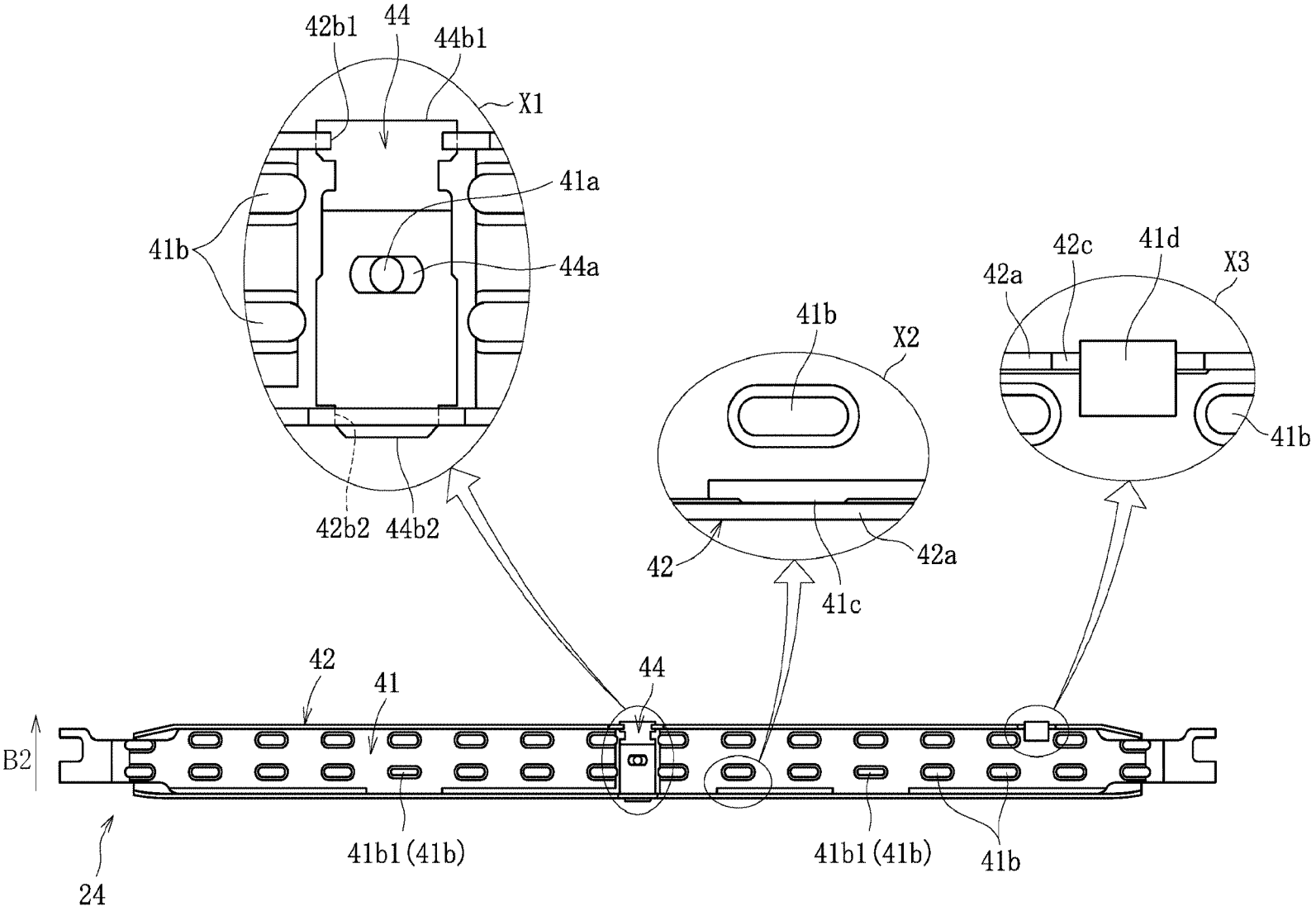
FIG. 8 is a plan view of the nip former depicted in FIG. 5.

As illustrated in FIG. 8, the screw 43 fastens and secures the securing member 44 to the base 41 substantially at a center of the base 41 and the thermal equalizer 42 in the longitudinal direction thereof, thus positioning the base 41 and the thermal equalizer 42 at the center of the base 41 and the thermal equalizer 42 in the longitudinal direction thereof. Accordingly, the base 41 and the thermal equalizer 42 barely shift to one of lateral ends of the base 41 and the thermal equalizer 42 in the longitudinal direction thereof. Consequently, the fixing device 6 suppresses uneven temperature of the fixing belt 21 in the axial direction thereof and uneven pressure exerted at the fixing nip N in the axial direction of the fixing belt 21.

According to the embodiments, the base 41 is made of resin. The thermal equalizer 42 is made of metal, that is, a material different from a material of the base 41. Hence, the base 41 and the thermal equalizer 42 have different thermal expansion coefficients, respectively. Thus, the base 41 and the thermal equalizer 42 have different coefficients of thermal expansion, respectively, that are caused by heat from the halogen heater 23. The base 41 and the thermal equalizer 42 are secured and positioned at a single position, that is, the center of the base 41 and the thermal equalizer 42 in the longitudinal direction thereof, respectively, thus releasing expansion of the base 41 and the thermal equalizer 42 to both lateral ends of each of the base 41 and the thermal equalizer 42 in the longitudinal direction thereof.

Additionally, according to the embodiments, as the inserting portion 44*b*1 of the securing member 44 is inserted into a downstream insertion hole of the thermal equalizer 42 in the rotation direction B2 of the fixing belt 21, that is, the insertion hole 42*b*1, in the direction D1 in FIG. 4A, side walls of the projections 41*b* depicted in FIG. 3 that sandwich the securing member 44 serve as guides that guide the securing member 44 in an inserting direction from one end to another end of the base 41 in the short direction thereof. Accordingly, the securing member 44 is inserted into the insertion holes 42*b*1 and 42*b*2 readily. Alternatively, separately from the projections 41*b*, ribs may extend from one end to another end of the base 41 in the short direction thereof and may sandwich the securing member 44, thus serving as guides that guide the securing member 44.

As illustrated in an enlarged view X1 in FIG. 8, as the inserting portions 44*b*1 and 44*b*2 of the securing member 44 are inserted into the insertion holes 42*b*1 and 42*b*2 of the thermal equalizer 42, respectively, the securing member 44 is positioned with respect to the thermal equalizer 42 in the horizontal direction in FIG. 8, that is, the longitudinal direction of the thermal equalizer 42. For example, as illustrated in FIG. 5, as both lateral ends of each of the inserting portions 44*b*1 and 44*b*2 in the longitudinal direction of the base 41 contact side walls of each of the insertion holes 42*b*1 and 42*b*2, respectively, motion of the securing member 44 with respect to the thermal equalizer 42 is restricted in the horizontal direction in FIGS. 5 and 8, that is, the longitudinal direction of the thermal equalizer 42. Accordingly, the securing member 44 positions the base 41 fastened to the securing member 44 with respect to the thermal equalizer 42 in the longitudinal direction thereof. According to the embodiments, a width of each of the insertion holes 42*b*1 and 42*b*2 and a width of each of the inserting portions 44*b*1 and 44*b*2 are determined by considering dimensional error and the like thereof, thus decreasing backlash between the inserting portion 44*b*1 and the insertion hole 42*b*1 and between the inserting portion 44*b*2 and the insertion hole 42*b*2.

Figure 9A:
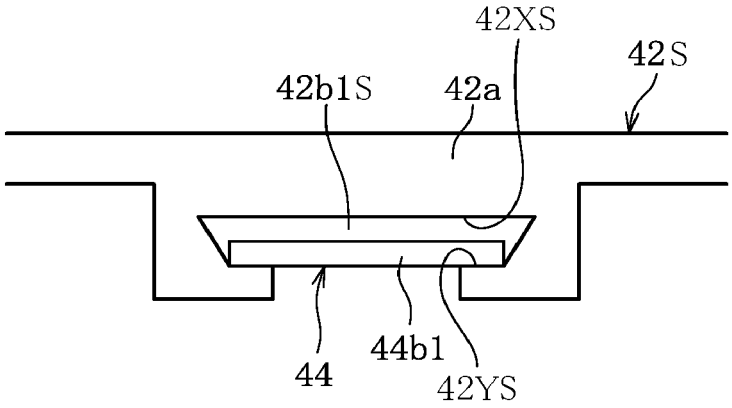
FIG. 9A is a plan view of the securing member and a thermal equalizer incorporating an insertion hole as a variation of the thermal equalizer depicted in FIG. 4A, illustrating the thermal equalizer contacting the securing member.
Figure 9B:
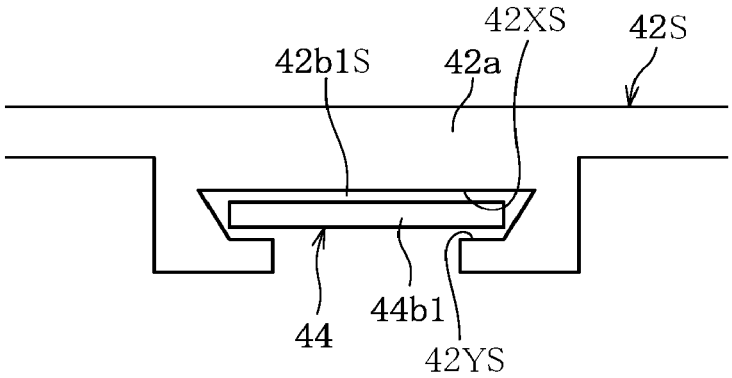
FIG. 9B is a plan view of the securing member and the thermal equalizer depicted in FIG. 9A, illustrating the thermal equalizer separated from the securing member.

According to the embodiments described above, the insertion holes 42*b*1 and 42*b*2 are substantially rectangular. Alternatively, as illustrated in FIG. 9A, the nip former 24 may employ a thermal equalizer 42S including an insertion hole 42*b*1S. The insertion hole 42*b*1S has an upstream wall 42XS (e.g., an upper face in FIG. 9A) that is disposed in proximity to the fixing nip N via the fixing belt 21 and a downstream wall 42YS (e.g., a lower face in FIG. 9A) that is opposite the upstream wall 42XS and is disposed downstream from the upstream wall 42XS in the pressurization direction PD of the pressure roller 22. A length of the upstream wall 42XS is greater than a length of the downstream wall 42YS in a longitudinal direction of the insertion hole 42*b*1S. Thus, as illustrated in FIG. 9A, the insertion hole 42*b*1S is substantially trapezoidal in cross section. Accordingly, as the thermal equalizer 42S is pressed by pressure from the pressure roller 22 and is moved toward the base 41, as illustrated in FIG. 9B, the inserting portion 44*b*1 moves toward the upstream wall 42XS of the insertion hole 42*b*1S having the greater length. Thus, the inserting portion 44*b*1 does not contact walls of the insertion hole 42*b*1S throughout an entire circumference of the inserting portion 44*b*1. For example, when the fixing device 6 performs fixing and the like, the inserting portion 44*b*1 does not contact the insertion hole 42*b*1S.

FIGS. 9A and 9B illustrate the insertion hole 42*b*1 S. Alternatively, the thermal equalizer 42S may incorporate the insertion hole 42*b*2 that has a construction similar to the construction of the insertion hole 42*b*1S or the thermal equalizer 42S may incorporate both the insertion hole 42*b*1S and the insertion hole 42*b*2 that has the construction similar to the construction of the insertion hole 42*b*1S.

According to the embodiments, a length of the securing member 44 is determined such that an amount of protrusion of the inserting portion 44*b*1 beyond the insertion hole 42*b*1 upward in FIG. 5 or an amount of protrusion of the inserting portion 44*b*2 beyond the insertion hole 42*b*2 downward in FIG. 5 decreases. For example, if the amount of protrusion of each of the inserting portions 44*b*1 and 44*b*2 increases excessively, the inserting portions 44*b*1 and 44*b*2 may interfere with the fixing belt 21 and other elements of the fixing device 6. Conversely, if the length of the securing member 44 decreases excessively, the inserting portions 44*b*1 and 44*b*2 may not reach the insertion holes 42*b*1 and 42*b*2, respectively. To address this circumstance, according to the embodiments, the dimensions of the inserting portions 44*b*1 and 44*b*2 and the insertion holes 42*b*1 and 42*b*2 are determined by considering dimensional error thereof so that the amount of protrusion of each of the inserting portions 44*b*1 and 44*b*2 decreases and the inserting portions 44*b*1 and 44*b*2 are precisely inserted into the insertion holes 42*b*1 and 42*b*2, respectively.

As illustrated in FIG. 2, the fixing belt 21 rotates upward in FIG. 2 at the fixing nip N. As the fixing belt 21 slides over the thermal equalizer 42 while the fixing belt 21 rotates, the fixing belt 21 pulls the thermal equalizer 42 upward in FIG. 2 and downstream in the sheet conveyance direction C1. Hence, the thermal equalizer 42 contacts the base 41 in an upstream end of the base 41 in the sheet conveyance direction C1, that is, a lower end of the base 41 in FIG. 2.

To address this circumstance, according to the embodiments, as illustrated in an enlarged view X2 in FIG. 8, the base 41 includes a contact portion 41*c* (e.g., a contact part) disposed at one end of the base 41 in the short direction thereof and at the upstream end of the base 41 in the sheet conveyance direction C1, that is, the lower end of the base 41 in FIG. 2. The contact portion 41*c* is disposed at a part of the base 41 in the longitudinal direction thereof and projects upstream in the sheet conveyance direction C1. The base 41 includes four contact portions 41*c*. That is, two lateral end contact portions 41*c* are disposed at both lateral ends of the base 41 in the longitudinal direction thereof, respectively. Two inboard contact portions 41*c* are disposed inboard from the two lateral end contact portions 41*c* in the longitudinal direction of the base 41, respectively. The two inboard contact portions 41*c* include the contact portion 41*c* illustrated in the enlarged view X2 in FIG. 8 and the contact portion 41*c* that is adjacent to the contact portion 41*c* illustrated in the enlarged view X2 via the center of the base 41 in the longitudinal direction thereof.

As described above, the contact portions 41*c* are disposed at the upstream end of the base 41 in the sheet conveyance direction C1 and face and contact the thermal equalizer 42. The contact portions 41*c* project toward the thermal equalizer 42 from a plurality of parts of the base 41 in the longitudinal direction thereof. Accordingly, the contact portions 41*c* restrict positions where the base 41 contacts the thermal equalizer 42, decreasing the contact area where the base 41 contacts the thermal equalizer 42. Consequently, the contact portions 41*c* decrease an amount of heat drawn to the base 41 from the thermal equalizer 42, reducing waste of heat that fails to be conducted to the fixing belt 21. Additionally, according to the embodiments, the contact portions 41*c* are disposed at both lateral ends of the base 41 in the longitudinal direction thereof, respectively. Accordingly, the base 41 contacts the thermal equalizer 42 at two distant positions of the base 41 in the longitudinal direction thereof, thus contacting the thermal equalizer 42 stably.

As illustrated in an enlarged view X3 in FIG. 8, the base 41 includes a protrusion 41*d* disposed at a part, that is, one end, of the base 41 in the longitudinal direction thereof and disposed at a downstream end of the base 41 in the sheet conveyance direction C1, the rotation direction B2 of the fixing belt 21, or the short direction of the base 41. The protrusion 41*d* projects downstream in the sheet conveyance direction C1. The thermal equalizer 42 includes a notch 42*c* disposed opposite the protrusion 41*d* and disposed at a downstream end of the thermal equalizer 42 in the rotation direction B2 of the fixing belt 21. The bent portion 42*a* is partially cut to produce the notch 42*c*. The protrusion 41*d* protrudes downstream in the rotation direction B2 of the fixing belt 21 and upward in FIG. 8 beyond an edge of the thermal equalizer 42. The notch 42*c* serves as a clearance that prevents the protrusion 41*d* from contacting the bent portion 42*a*.

The protrusion 41*d* and the notch 42*c* serve as an assembly error preventing mechanism that prevents the base 41 from being attached to the thermal equalizer 42 erroneously. For example, even if the base 41 is attached to the thermal equalizer 42 erroneously upside down in FIG. 8 or inside out, the protrusion 41*d* is not placed in the notch 42*c* and comes into contact with the bent portion 42*a* of the thermal equalizer 42, prohibiting the base 41 from being attached to the thermal equalizer 42 and preventing the base 41 from being attached to the thermal equalizer 42 in an erroneous direction.

For example, according to the embodiments, the base 41 includes the protrusion 41*d* and the thermal equalizer 42 is cut partially to produce the notch 42*c*, suppressing modification of components of the thermal equalizer 42 and decreasing difference in the thermal capacity between a left part and a right part of the thermal equalizer 42 in FIG. 8. Hence, erroneous attachment of the base 41 to the thermal equalizer 42 is prevented while suppressing unevenness in thermal equalization of the fixing belt 21 by the thermal equalizer 42. As described above, as the fixing belt 21 rotates, the thermal equalizer 42 contacts the base 41 at the upstream end of the base 41 in the sheet conveyance direction C1 with a substantial contact force. Conversely, a gap is produced easily between the thermal equalizer 42 and the base 41 at the downstream end of the base 41 in the sheet conveyance direction C1. Hence, the thermal equalizer 42 has the notch 42*c* disposed opposite the downstream end of the base 41, improving the strength of the base 41 and the thermal equalizer 42 advantageously.

Figure 10:
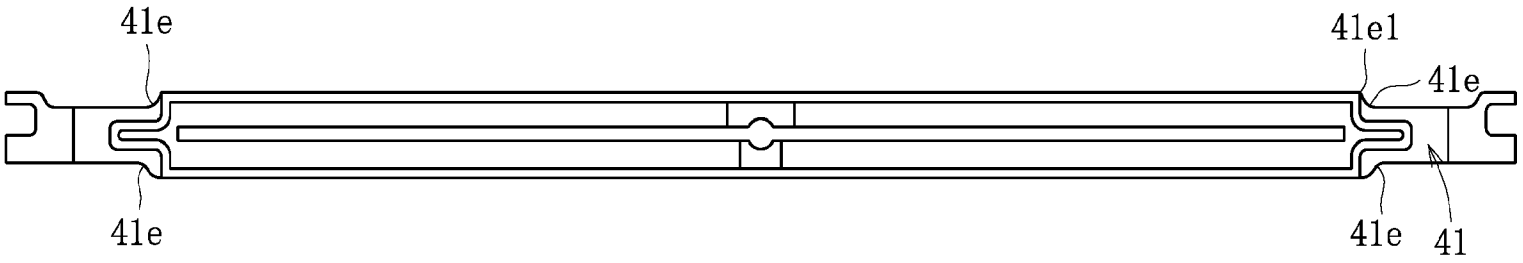
FIG. 10 is a plan view of a face of the base, that faces the thermal equalizer depicted in FIG. 4A.

FIG. 10 is a diagram illustrating a face of the base 41, that faces the thermal equalizer 42. As illustrated in FIG. 10, the base 41 includes a plurality of tapers 41*e* disposed at both lateral ends of the base 41 in the longitudinal thereof, respectively. Each of the tapers 41*e* decreases a width of the base 41 in the short direction thereof.

Figure 11:
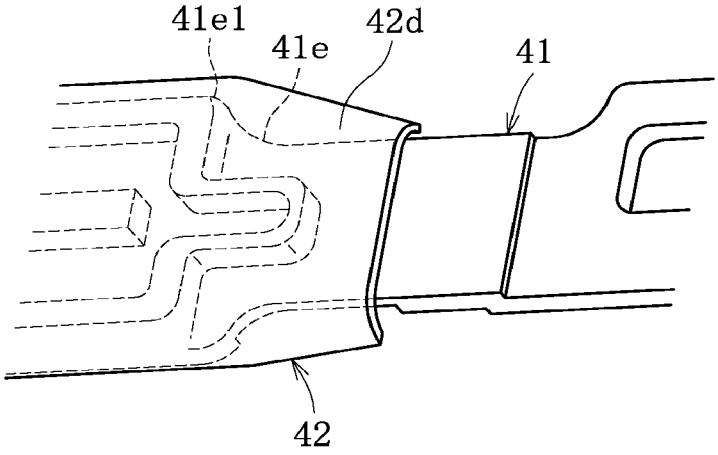
FIG. 11 is a perspective view of the thermal equalizer and the base depicted in FIG. 10, illustrating a lateral end of the thermal equalizer and the base in a longitudinal direction thereof.

As illustrated in FIG. 11, the thermal equalizer 42 includes a taper 42*d* that is curved in cross section at a lateral end of the thermal equalizer 42 in the longitudinal direction thereof. The taper 42*d* prevents each lateral end of the thermal equalizer 42 in the longitudinal direction thereof from being angled. While the fixing belt 21 slides over the taper 42*d*, the taper 42*d* prevents the fixing belt 21 from being shaved and suffering from abrasion. The base 41 includes the taper 41*e* that decreases the width in the short direction of the base 41 at a lateral end of the base 41 in the longitudinal direction thereof so that the taper 42*d* of the thermal equalizer 42 accommodates the lateral end of the base 41.

Additionally, according to this embodiment, the taper 41*e* of the base 41 includes an origin 41*e*1, that is, a boundary between a curved portion and a plane. A periphery of the origin 41*e*1 contacts an inner face of the taper 42*d* of the thermal equalizer 42, restricting motion of the base 41 with respect to the thermal equalizer 42 in the longitudinal direction thereof.

Figure 12:
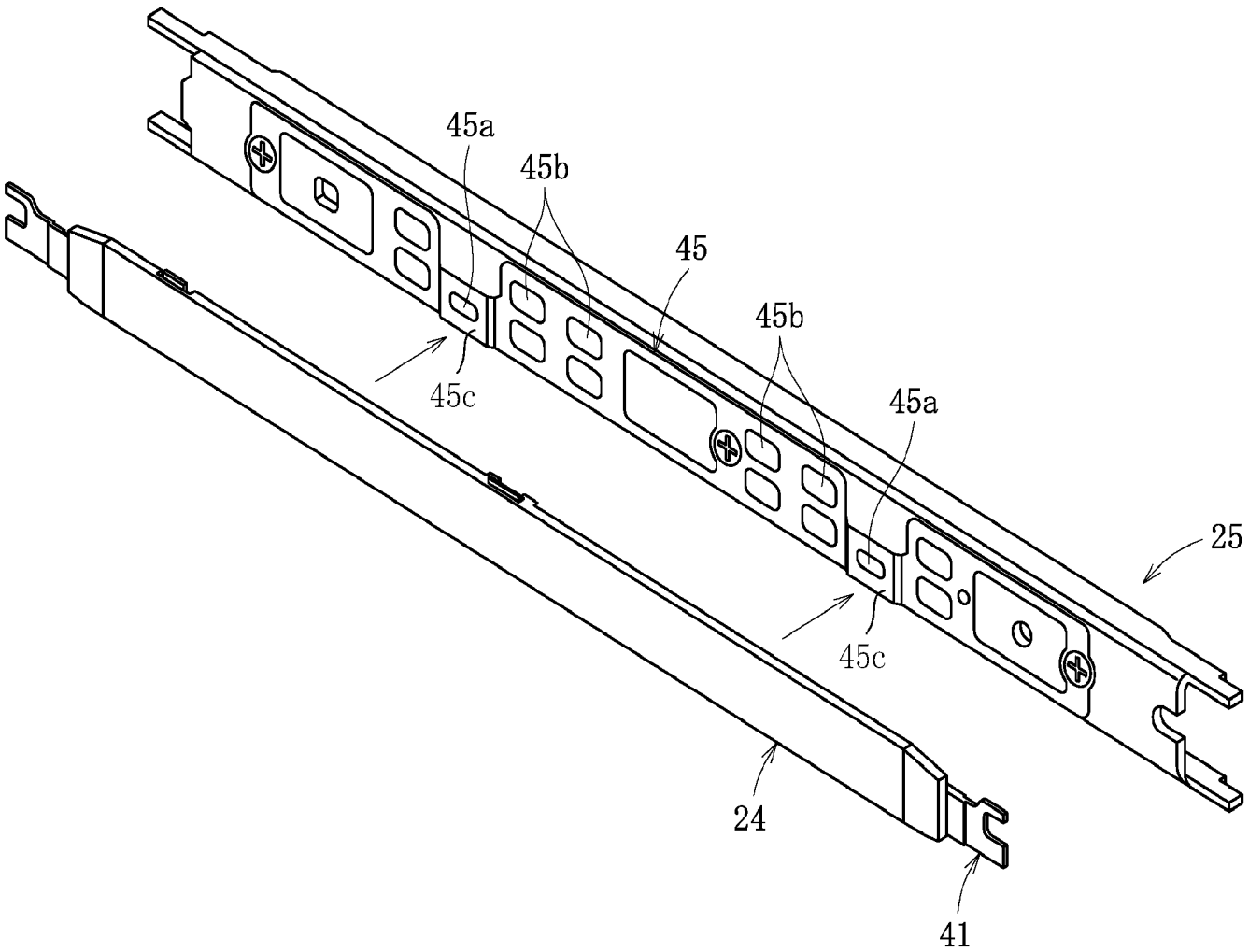
FIG. 12 is a perspective view of the nip former and a stay incorporated in the fixing device depicted in FIG. 2, illustrating the nip former before being attached to the stay.

Referring to FIG. 12, a description is provided of an attachment construction for attaching the nip former 24 to the stay 25.

The nip former 24 is attached to the stay 25 in directions indicated with arrows in FIG. 12.

As illustrated in FIG. 12, a holder 45 that holds the nip former 24 is secured to a nip former side face of the stay 25, that faces the nip former 24.

The holder 45 includes a plurality of holding holes 45*a* and a plurality of holes 45*b*. The holding holes 45*a* hold the base 41. The holes 45*b* are disposed opposite the projections 41*b* of the base 41 depicted in FIG. 8, respectively. The holder 45 includes steps 45*c* provided with the holding holes 45*a*, respectively. The steps 45*c* protrude toward the nip former 24 by a single step beyond other part of the holder 45.

Figure 13:
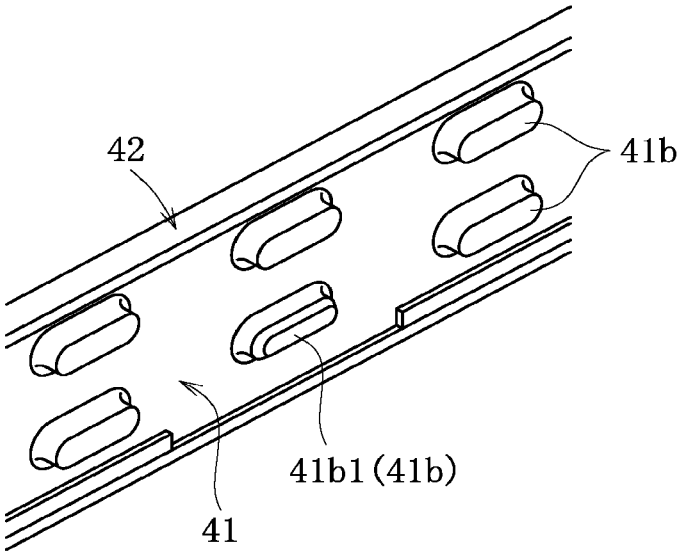
FIG. 13 is a perspective view of the base of the nip former depicted in FIG. 12, illustrating a face of the base, that is attached to the stay.

As illustrated in FIGS. 8 and 13, the base 41 includes the plurality of projections 41*b*. The projections 41*b* include a projection 41*b*1 that is inserted into the holding hole 45*a* of the holder 45. As illustrated in FIG. 13, the projection 41*b*1 includes an edge face that faces the holder 45 and is treated with C-chamfering. Thus, the projection 41*b*1 is inserted into the holding hole 45*a* smoothly. The projections 41*b* other than the projection 41*b*1 contact the stay 25 through the holes 45*b* of the holder 45, respectively, thus serving as positioners that position the nip former 24 with respect to the stay 25.

The above describes the embodiments of the present disclosure. However, the technology of the present disclosure is not limited to the embodiments described above and is modified within the scope of the present disclosure.

The nip former 24 according to the embodiments of the present disclosure is applicable to a fixing device 6S incorporating a plurality of heaters as described below with reference to FIG. 14. The following describes mainly a construction of the fixing device 6S, that is different from the construction described above of the fixing device 6 depicted in FIG. 2. A description of a construction of the fixing device 6S, that is common to the fixing device 6, is omitted properly.

Figure 14:
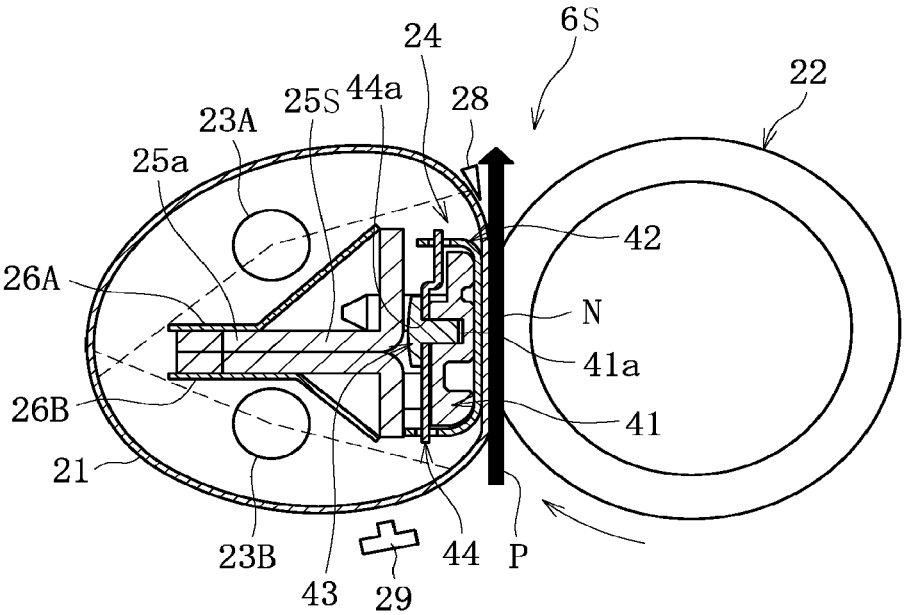
FIG. 14 is a cross-sectional view of a fixing device according to another embodiment of the present disclosure, that is installable in the image forming apparatus depicted in FIG. 1.

As illustrated in FIG. 14, like the fixing device 6 according to the embodiments described above, the fixing device 6S includes the fixing belt 21 serving as a belt, the pressure roller 22, and the nip former 24. The fixing device 6S according to this embodiment further includes two heaters 23A and 23B. One of the heaters 23A and 23B has a center heat generating span disposed in a center of the one of the heaters 23A and 23B in a longitudinal direction thereof. The center heat generating span corresponds to a small sheet. Another one of the heaters 23A and 23B has a lateral end heat generating span disposed in each lateral end of the another one of the heaters 23A and 23B in the longitudinal direction thereof. The lateral end heat generating span corresponds to a large sheet. According to this embodiment, a halogen heater is used as each of the heaters 23A and 23B. Alternatively, an induction heater (IH), a resistive heat generator, a carbon heater, or the like may be used.

The fixing device 6S includes a stay 25S that is T-shaped in cross section. The stay 25S includes an arm 25*a* that projects from a base of the stay 25S in a direction opposite a direction directed to the fixing nip N. The arm 25*a* isolates the heater 23A from the heater 23B.

The power supply disposed in the body of the image forming apparatus 1 controls output to the heaters 23A and 23B to generate heat. The output to the heaters 23A and 23B is controlled based on a temperature of the surface of the fixing belt 21, which is detected by a temperature sensor 29 disposed opposite an outer circumferential surface of the fixing belt 21. Such control of the output to the heaters 23A and 23B adjusts the temperature, that is, the fixing temperature, of the fixing belt 21 to the desired temperature.

A reflector 26A is interposed between the heater 23A and the stay 25S. A reflector 26B is interposed between the heater 23B and the stay 25S. The reflectors 26A and 26B improve heating efficiency of the heaters 23A and 23B to heat the fixing belt 21 and prevent radiant heat from the heaters 23A and 23B from heating the stay 25S, suppressing waste of energy.

The fixing device 6S also employs the nip former 24 having the construction described above. Accordingly, the base 41 and the thermal equalizer 42 are positioned precisely, preventing failures such as faulty fixing of a toner image on a sheet P and jamming of the sheet P conveyed through the fixing device 6S. Further, the contact area where the thermal equalizer 42 contacts the securing member 44 decreases.

The image forming apparatus 1 according to the embodiments of the present disclosure is not limited to a color image forming apparatus depicted in FIG. 1 that forms a color toner image. Alternatively, the image forming apparatus 1 may be a monochrome image forming apparatus that forms a monochrome toner image, a copier, a printer, a facsimile machine, a multifunction peripheral (MFP) having at least two of copying, printing, facsimile, scanning, and plotter functions, or the like.

The recording media include, in addition to plain paper as a sheet P, thick paper, a postcard, an envelope, thin paper, coated paper, art paper, tracing paper, an overhead projector (OHP) transparency, plastic film, prepreg, and copper foil.

The above describes examples according to the embodiments of the present disclosure in which a nip former (e.g., the nip former 24) is applied to a fixing device (e.g., the fixing devices 6 and 6S) installed in an image forming apparatus (e.g., the image forming apparatus 1). Alternatively, the nip former according to the embodiments of the present disclosure is also applicable to a dryer that dries a drying target. For example, the nip former according to the embodiments of the present disclosure is also applicable to a dryer installed in an image forming apparatus employing an inkjet method. The dryer dries ink of an image formed on a surface of a recording medium such as a sheet.

A description is provided of advantages of a nip former (e.g., the nip former 24).

As illustrated in FIGS. 7A and 7B, the nip former includes a base (e.g., the base 41), an enhanced thermal conductor (e.g., the thermal equalizers 42 and 42S), and a securing member (e.g., the securing member 44). The base has a first thermal conductivity. The enhanced thermal conductor has a second thermal conductivity greater than the first thermal conductivity of the base. The securing member is separately provided from the base and the enhanced thermal conductor. The nip former contacts an inner circumferential surface of a belt (e.g., the fixing belt 21). The nip former is pressed by an opposed rotator (e.g., the pressure roller 22) in a pressurization direction (e.g., the pressurization direction PD) via the belt rotatable in a rotation direction (e.g., the rotation direction B2) to form a nip (e.g., the fixing nip N) between the belt and the opposed rotator. The enhanced thermal conductor includes an insertion hole (e.g., the insertion holes 42*b*1, 42*b*1S, and 42*b*2). The securing member includes an inserting portion (e.g., the inserting portions 44*b*1 and 44*b*2) inserted into the insertion hole in a direction perpendicular to the pressurization direction of the opposed rotator. The insertion hole has a first width in the pressurization direction of the opposed rotator, that is greater than a second width of the inserting portion in the pressurization direction of the opposed rotator.

As the inserting portion is inserted into the insertion hole, the securing member is attached to the enhanced thermal conductor such that the enhanced thermal conductor and the securing member sandwich the base. The insertion hole includes an upstream wall (e.g., the upstream walls 42X and 42XS) and a downstream wall (e.g., the downstream walls 42Y and 42YS) in the pressurization direction of the opposed rotator. In a state in which the securing member attached to the enhanced thermal conductor is secured to the base and the opposed rotator presses against the enhanced thermal conductor via the belt, the inserting portion does not contact the upstream wall and the downstream wall of the insertion hole in the pressurization direction of the opposed rotator and a direction (e.g., the direction DD) opposite the pressurization direction of the opposed rotator.

Accordingly, the nip former decreases the contact area where the securing member contacts the enhanced thermal conductor.

According to the embodiments described above, the fixing belt 21 serves as a belt. Alternatively, a fixing film, a fixing sleeve, or the like may be used as a belt. Further, the pressure roller 22 serves as an opposed rotator. Alternatively, a pressure belt or the like may be used as an opposed rotator.

The above-described embodiments are illustrative and do not limit the present disclosure. Thus, numerous additional modifications and variations are possible in light of the above teachings. For example, elements and features of different illustrative embodiments may be combined with each other and substituted for each other within the scope of the present disclosure.

Any one of the above-described operations may be performed in various other ways, for example, in an order different from the one described above.

What is claimed is:

1. A nip former configured to be pressed by an opposed rotator in a pressurization direction via a belt rotatable in a rotation direction to form a nip between the belt and the opposed rotator, the nip former comprising:

a base;

an enhanced thermal conductor including at least one insertion hole having a first width in the pressurization direction of the opposed rotator, the at least one insertion hole including:

an upstream wall; and a downstream wall disposed downstream from the upstream wall in the pressurization direction of the opposed rotator; and a securing member separately provided from the base and the enhanced thermal conductor, the securing member including at least one inserting portion configured to be inserted into the at least one insertion hole in a direction perpendicular to the pressurization direction of the opposed rotator to attach the securing member to the enhanced thermal conductor such that the enhanced thermal conductor and the securing member sandwich the base, the at least one inserting portion having a second width in the pressurization direction of the opposed rotator, the second width being smaller than the first width of the at least one insertion hole, the at least one inserting portion configured not to contact the upstream wall and the downstream wall of the at least one insertion hole in the pressurization direction of the opposed rotator and a direction opposite the pressurization direction of the opposed rotator in a state in which the securing member is secured to the base and the opposed rotator presses against the enhanced thermal conductor via the belt.

2. The nip former according to claim 1, wherein the base includes:

an upstream face configured to contact the enhanced thermal conductor; and a downstream face disposed downstream from the upstream face in the pressurization direction of the opposed rotator, the downstream face configured to contact the securing member.

3. The nip former according to claim 2, wherein the at least one inserting portion is disposed at each of an upstream end and a downstream end of the securing member in the rotation direction of the belt, and wherein the at least one insertion hole is disposed at each of an upstream end and a downstream end of the enhanced thermal conductor in the rotation direction of the belt.

4. The nip former according to claim 3, wherein the at least one insertion hole includes:

an upstream insertion hole; and a downstream insertion hole disposed downstream from the upstream insertion hole in the rotation direction of the belt, wherein the at least one inserting portion includes:

an upstream inserting portion; and a downstream inserting portion disposed downstream from the upstream inserting portion in the rotation direction of the belt, and wherein each of the upstream inserting portion and the downstream inserting portion includes:

an upstream face; and a downstream face disposed downstream from the upstream face in the pressurization direction of the opposed rotator.

5. The nip former according to claim 4, wherein a distance La defines a distance in the pressurization direction of the opposed rotator from a contact position where the base contacts the enhanced thermal conductor to the upstream wall of the upstream insertion hole, wherein a distance Le defines a distance in the pressurization direction of the opposed rotator from the contact position to the upstream wall of the downstream insertion hole, wherein a distance Lb defines a distance in the pressurization direction of the opposed rotator from the contact position to the upstream face of the upstream inserting portion, wherein a distance Lf defines a distance in the pressurization direction of the opposed rotator from the contact position to the upstream face of the downstream inserting portion, wherein a distance Lc defines a distance in the pressurization direction of the opposed rotator, the distance Lc obtained by adding the second width of the upstream inserting portion to the distance Lb, wherein a distance Lg defines a distance in the pressurization direction of the opposed rotator, the distance Lg obtained by adding the second width of the downstream inserting portion to the distance Lf, wherein a distance Ld defines a distance in the pressurization direction of the opposed rotator, the distance Ld obtained by adding the first width of the upstream insertion hole to the distance La, wherein a distance Lh defines a distance in the pressurization direction of the opposed rotator, the distance Lh obtained by adding the first width of the downstream insertion hole to the distance Le, wherein a first dimensional relation defines a relation in which the distance Lb is greater than the distance La and the distance Ld is greater than the distance Lc, wherein a second dimensional relation defines a relation in which the distance Lf is greater than the distance Le and the distance Lh is greater than the distance Lg, and wherein at least one of the first dimensional relation and the second dimensional relation is satisfied.

6. The nip former according to claim 1, wherein the upstream wall has a first length in a longitudinal direction of the enhanced thermal conductor, wherein the downstream wall has a second length in the longitudinal direction of the enhanced thermal conductor, and wherein the first length is greater than the second length.

7. The nip former according to claim 1, wherein the enhanced thermal conductor is made of metal.

8. The nip former according to claim 7, wherein the base includes a contact portion disposed at an upstream end of the base in the rotation direction of the belt and disposed at a part of the base in a longitudinal direction of the base, the contact portion configured to project toward the enhanced thermal conductor and contact the enhanced thermal conductor.

9. The nip former according to claim 8, wherein the contact portion is disposed at each lateral end of the base in the longitudinal direction of the base.

10. The nip former according to claim 1, wherein the base includes a protrusion disposed at a downstream end of the base in the rotation direction of the belt and disposed at a part of the base in a longitudinal direction of the base, the protrusion configured to protrude downstream in the rotation direction of the belt.

11. The nip former according to claim 10, wherein the enhanced thermal conductor further includes a clearance disposed at a downstream end of the enhanced thermal conductor in the rotation direction of the belt and disposed opposite the protrusion, the clearance configured to prevent the protrusion from contacting the enhanced thermal conductor.

12. The nip former according to claim 1, wherein the base has a first thermal conductivity and the enhanced thermal conductor has a second thermal conductivity greater than the first thermal conductivity of the base.

13. The nip former according to claim 1, further comprising a screw configured to secure the securing member to the base.

14. The nip former according to claim 1, wherein the at least one insertion hole is trapezoidal in cross section.

15. The nip former according to claim 1, wherein the base includes a first taper disposed at a lateral end of the base in a longitudinal direction of the base, and wherein the enhance thermal conductor further includes a second taper curved in cross section and disposed at a lateral end of the enhanced thermal conductor in a longitudinal direction of the enhanced thermal conductor, the second taper configured to accommodate the first taper.

16. A fixing device comprising:

a belt configured to rotate in a rotation direction;

an opposed rotator disposed opposite the belt;

a heater configured to heat the belt; and a nip former configured to be pressed by the opposed rotator in a pressurization direction via the belt to form a fixing nip between the belt and the opposed rotator, the nip former including:

a base;

an enhanced thermal conductor including at least one insertion hole having a first width in the pressurization direction of the opposed rotator, the at least one insertion hole including:

an upstream wall; and a downstream wall disposed downstream from the upstream wall in the pressurization direction of the opposed rotator; and a securing member separately provided from the base and the enhanced thermal conductor, the securing member including at least one inserting portion configured to be inserted into the at least one insertion hole in a direction perpendicular to the pressurization direction of the opposed rotator to attach the securing member to the enhanced thermal conductor such that the enhanced thermal conductor and the securing member sandwich the base, the at least one inserting portion having a second width in the pressurization direction of the opposed rotator, the second width being smaller than the first width of the at least one insertion hole, the at least one inserting portion configured not to contact the upstream wall and the downstream wall of the at least one insertion hole in the pressurization direction of the opposed rotator and a direction opposite the pressurization direction of the opposed rotator in a state in which the securing member is secured to the base and the opposed rotator presses against the enhanced thermal conductor via the belt.

17. The nip former according to claim 16, wherein the enhanced thermal conductor contacts an inner circumferential surface of the belt.

18. The fixing device according to claim 16, further comprising a holder including a holding hole, wherein the base includes a projection configured to be inserted into the holding hole of the holder.

19. An image forming apparatus comprising:

an image forming device configured to form an image; and a fixing device configured to fix the image on a recording medium, the fixing device including:

a belt configured to rotate in a rotation direction;

an opposed rotator disposed opposite the belt;

a heater configured to heat the belt; and a nip former configured to be pressed by the opposed rotator in a pressurization direction via the belt to form a fixing nip between the belt and the opposed rotator, the nip former including:

a base;

an enhanced thermal conductor including at least one insertion hole having a first width in the pressurization direction of the opposed rotator, the at least one insertion hole including:

an upstream wall; and a downstream wall disposed downstream from the upstream wall in the pressurization direction of the opposed rotator; and a securing member separately provided from the base and the enhanced thermal conductor, the securing member including at least one inserting portion configured to be inserted into the at least one insertion hole in a direction perpendicular to the pressurization direction of the opposed rotator to attach the securing member to the enhanced thermal conductor such that the enhanced thermal conductor and the securing member sandwich the base, the at least one inserting portion having a second width in the pressurization direction of the opposed rotator, the second width being smaller than the first width of the at least one insertion hole, the at least one inserting portion configured not to contact the upstream wall and the downstream wall of the at least one insertion hole in the pressurization direction of the opposed rotator and a direction opposite the pressurization direction of the opposed rotator in a state in which the securing member is secured to the base and the opposed rotator presses against the enhanced thermal conductor via the belt.

* * * * *